US008002016B2

(12) United States Patent
Rees et al.

(10) Patent No.: US 8,002,016 B2
(45) Date of Patent: Aug. 23, 2011

(54) STRIP CASTING APPARATUS WITH CASTING ROLL POSITIONING

(75) Inventors: Harold Bradley Rees, Ladoga, IN (US); Ansgar Gruess, Erlangen (DE); James D. Edwards, Lafayette, IN (US)

(73) Assignees: Nucor Corporation, Charlotte, NC (US); Siemens Aktiengesellschaft, Munich (DE)

( * ) Notice: Subject to any disclaimer, the term of this patent is extended or adjusted under 35 U.S.C. 154(b) by 324 days.

(21) Appl. No.: 12/404,684

(22) Filed: Mar. 16, 2009

(65) Prior Publication Data

US 2009/0236067 A1 Sep. 24, 2009

Related U.S. Application Data

(60) Provisional application No. 61/037,714, filed on Mar. 19, 2008.

(51) Int. Cl.
*B22D 11/06* (2006.01)

(52) U.S. Cl. ..... 164/480; 164/428

(58) Field of Classification Search ..... 164/428, 164/480

See application file for complete search history.

(56) References Cited

U.S. PATENT DOCUMENTS

| | | | |
|---|---|---|---|
| 3,837,894 | A | 9/1974 | Tucker |
| 4,376,661 | A | 3/1983 | Takechi et al. |
| 4,398,970 | A | 8/1983 | Marder |
| 4,436,561 | A | 3/1984 | Takahashi et al. |
| 4,609,410 | A | 9/1986 | Hu |
| 4,708,748 | A | 11/1987 | Satoh et al. |
| 4,770,719 | A | 9/1988 | Hashiguchi et al. |
| 5,191,927 | A | 3/1993 | Terado et al. |
| 5,328,528 | A | 7/1994 | Chen |
| 5,470,403 | A | 11/1995 | Yoshinaga et al. |
| 5,706,882 | A | 1/1998 | Fellus et al. |
| 5,762,126 | A | 6/1998 | Assefpour-Dezfully |
| 5,787,967 | A | 8/1998 | Vendeville et al. |
| 5,816,311 | A | 10/1998 | Osada et al. |
| 5,960,855 | A | 10/1999 | Assefpour-Dezfully |
| 5,960,856 | A | 10/1999 | Blejde et al. |
| 6,044,895 | A | 4/2000 | Kuttner et al. |
| 6,164,366 | A | 12/2000 | Fish |
| 6,167,942 | B1 | 1/2001 | Fish |

(Continued)

FOREIGN PATENT DOCUMENTS

| | | | |
|---|---|---|---|
| DE | 3009680 | B1 | 8/1980 |

(Continued)

*Primary Examiner* — Kuang Lin
(74) *Attorney, Agent, or Firm* — Hahn Loeser & Parks LLP

(57) ABSTRACT

An apparatus and method for continuously casting thin steel strip includes a pair of counter-rotatable casting rolls laterally positioned to form a nip there between through which thin cast strip can be cast, an actuator capable of moving each casting roll independently toward and away from a given reference location as desired, location sensors capable of sensing the location of the casting rolls relative to the given reference location and producing electrical signals indicative of each casting roll position and a control system capable of receiving the electrical signals and causing the actuator to move the casting rolls into desired position. Force sensors may be provided capable of sensing the forces exerted on the strip and producing electrical signals indicative of the sensed forces, and the control system may be capable of receiving the electrical signals indicative of the sensed forces and causing actuators to vary the position of the casting rolls responsive to the electrical signals as desired.

44 Claims, 15 Drawing Sheets

U.S. PATENT DOCUMENTS

| | | | |
|---|---|---|---|
| 6,167,943 | B1 | 1/2001 | Fish |
| 6,210,496 | B1 | 4/2001 | Takagi et al. |
| 6,312,536 | B1 | 11/2001 | Omiya |
| 6,397,924 | B1 | 6/2002 | Fish |
| 6,408,222 | B1 | 6/2002 | Kim et al. |
| 6,423,426 | B1 | 7/2002 | Kobayashi et al. |
| 6,440,584 | B1 | 8/2002 | Nagataki et al. |
| 6,536,504 | B2 | 3/2003 | Takeuchi et al. |
| 6,537,394 | B1 | 3/2003 | Osawa et al. |
| 6,575,225 | B1 | 6/2003 | Hohenbichler |
| 6,641,931 | B2 | 11/2003 | Claessens |
| 6,673,171 | B2 | 1/2004 | Hlady |
| 6,676,774 | B2 | 1/2004 | Matsuoka et al. |
| 6,702,904 | B2 | 3/2004 | Kami et al. |
| 6,706,419 | B2 | 3/2004 | Yoshinaga et al. |
| 6,709,535 | B2 | 3/2004 | Utsumi et al. |
| 6,739,384 | B2 | 5/2004 | Schoen et al. |
| 6,776,218 | B2 | 8/2004 | Glutz |
| 6,811,624 | B2 | 11/2004 | Hoydick |
| 6,814,819 | B2 | 11/2004 | Matsuoka et al. |
| 6,818,074 | B2 | 11/2004 | Matsuoka et al. |
| 6,837,301 | B2 | 1/2005 | Nikolovski |
| 6,869,691 | B2 | 3/2005 | Nagataki |
| 6,886,623 | B2 | 5/2005 | Kato et al. |
| 6,920,912 | B2 | 7/2005 | Blejde |
| 6,942,013 | B2 | 9/2005 | Strezov |
| 6,988,530 | B2 | 1/2006 | Nikolovski |
| 7,073,565 | B2 | 7/2006 | Nikolovski et al. |
| 7,118,809 | B2 | 10/2006 | Utsumi |
| 7,140,416 | B2 | 11/2006 | Bassarutti et al. |
| 7,156,150 | B2 | 1/2007 | Zahedi et al. |
| 7,191,819 | B2 | 3/2007 | Cooper et al. |
| 7,311,789 | B2 | 12/2007 | Hoydick |
| 7,381,478 | B2 | 6/2008 | Yokoi et al. |
| 7,396,420 | B2 | 7/2008 | Matsuoka et al. |
| 7,442,268 | B2 | 10/2008 | Sun |
| 7,464,746 | B2 | 12/2008 | Edwards |
| 7,534,312 | B2 | 5/2009 | Yoshinaga et al. |
| 2002/0157807 | A1* | 10/2002 | Nikolovski et al. ..... 164/454 |
| 2003/0041932 | A1 | 3/2003 | Tosaka et al. |
| 2003/0084966 | A1 | 5/2003 | Ikeda et al. |
| 2003/0129444 | A1 | 7/2003 | Matsuoka et al. |
| 2004/0003774 | A1 | 1/2004 | Moore |
| 2004/0035500 | A1 | 2/2004 | Ikeda et al. |
| 2004/0047756 | A1 | 3/2004 | Rege et al. |
| 2004/0079514 | A1 | 4/2004 | Strezov et al. |
| 2004/0108024 | A1 | 6/2004 | Matsouka et al. |
| 2004/0206471 | A1 | 10/2004 | Blejde et al. |
| 2004/0238080 | A1 | 12/2004 | Vandeputte et al. |
| 2004/0238082 | A1 | 12/2004 | Hasegawa et al. |
| 2005/0016644 | A1 | 1/2005 | Matsouka et al. |
| 2005/0019601 | A1 | 1/2005 | Matsouka et al. |
| 2005/0173093 | A1* | 8/2005 | Botham et al. ..... 164/480 |
| 2006/0191612 | A1 | 8/2006 | Yoshida et al. |
| 2007/0003774 | A1 | 1/2007 | McDaniel |
| 2007/0158046 | A1 | 7/2007 | Cooper et al. |
| 2009/0049882 | A1 | 2/2009 | Flick et al. |
| 2009/0090484 | A1 | 4/2009 | d'Hone et al. |

FOREIGN PATENT DOCUMENTS

| | | | |
|---|---|---|---|
| EP | 0487056 | B1 | 2/1995 |
| EP | 0969112 | A1 | 1/2000 |
| EP | 191114 | A1 | 3/2002 |
| EP | 1291448 | A1 | 3/2003 |
| GB | 1501902 | | 2/1978 |
| JP | 4066247 | A | 3/1992 |
| JP | 8029401 | B2 | 3/1996 |
| JP | 10109150 | A | 4/1998 |
| JP | 11090588 | A | 4/1999 |
| JP | 2000237858 | A | 9/2000 |
| JP | 2006187792 | A | 7/2006 |
| KR | 20020017028 | A | 3/2002 |
| WO | 03023074 | | 3/2003 |

* cited by examiner

STRIP CASTING APPARATUS WITH CASTING ROLL POSITIONING

This application gains the benefit of U.S. Provisional Patent Application No. 61/037,714, filed Mar. 19, 2008, which is incorporated herein by reference.

BACKGROUND AND SUMMARY

This invention relates to the casting of metal strip by continuous casting in a twin roll caster.

In a twin roll caster molten metal is introduced between a pair of counter-rotated horizontal casting rolls that are cooled so that metal shells solidify on the moving roll surfaces and are brought together at a nip between them to produce a solidified strip product, delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

Further, the twin roll caster may be capable of continuously producing cast strip from molten steel through a sequence of ladles. Pouring the molten metal from the ladle into smaller vessels before flowing through the metal delivery nozzle enables the exchange of an empty ladle with a full ladle without disrupting the production of cast strip.

The casting rolls must be accurately set to properly define an appropriate width for the nip, generally of the order of a few millimeters or less. There must also be some means for allowing at least one of the rolls to move relative to the other casting roll to accommodate fluctuations in strip thickness, particularly during start up.

In the past, one of the casting rolls was mounted in fixed journals or was mounted in supports urged against physical stops. The other casting roll was rotatably mounted on supports that could move outwardly against the action of a resisting force enabling that roll to move laterally to accommodate fluctuations in strip thickness. The resisting force was applied by helical compression springs, or alternatively, pressure fluid cylinder units.

A strip caster with spring resisting force against the laterally moveable roll is disclosed in U.S. Pat. No. 6,167,943 to Fish et al. In that case the resistive springs act between roll supports and a pair of thrust reaction structures, the positions of which can be set by operation of a pair of powered mechanical jacks to enable adjustment of the initial compression of the springs to set initial compression forces. The initial compression forces are generally equal at both ends of the roll. The positions of the roll supports on the moveable casting roll are subsequently adjusted after commencement of casting, so that the gap between the rolls is constant across the width of the nip to produce a strip of constant profile. However, as casting continues the profile of the strip will inevitably vary due to eccentricities in the rolls and dynamic changes due to variable heat expansion and other dynamic effects. U.S. Pat. No. 6,167,943 does not provide strip thickness profile control to suppress thickness profile fluctuations during casting.

U.S. Pat. No. 6,837,301 to Nikolovski, et al. provides for controlling strip thickness profile during casting using sensors positioned downstream of the nip. However, U.S. Pat. No. 6,837,301 discloses strip thickness profile control obtained by enabling one of the casting rolls to move laterally outward from the other casting roll against variable resistive forces. The other casting roll is maintained substantially fixed against an adjustable stop.

There remains a need to improve control over the forces that the rolls apply against the strip irrespective of the variation in thickness profile of the strip during production. An apparatus is disclosed for continuously casting thin steel strip comprising:

(a) a pair of counter-rotatable casting rolls having casting surfaces laterally positioned to form a nip there between through which thin cast strip can be cast, and on which a casting pool of molten metal can be formed supported on the casting surfaces above the nip, (b) at least one actuator capable of moving laterally each casting roll independently toward and away from a given reference location as desired, (c) location sensors capable of sensing the location of the casting rolls relative to the given reference location and producing electrical signals indicative of each casting roll position in relation to the given reference location, and (d) a control system capable of receiving the electrical signals indicative of each casting roll position and causing the actuator to move the casting rolls into desired position relative to the reference location for casting metal strip.

Each casting roll may be mounted on a roll cassette, and may further include actuators disconnectable from the casting rolls to enable the casting rolls to be changed out without dismantling the actuators.

By independently moving, each casting roll is able to move toward and away from the reference location and the nip between the casting rolls. There are reaction forces on the casting rolls from the cast strip and the movement of the adjacent casting roll, but these reaction forces are forces to which the independent movement of the casting rolls is responsive. Usually separate actuators are provided capable of independently moving each casting roll relative to the given reference location, although with mechanical linkage it may be possible to provide independent movement of the casting rolls with one actuator mechanism. The actuators may also be provided to vary the distance between the casting rolls at each end of the casting rolls independently as desired. In any event, the actuators may be selected from the group consisting of servo-mechanisms, hydraulic mechanisms, pneumatic mechanisms, rotating actuators and magnetostrictive actuators, and be capable of moving the casting rolls independently to vary the distance between each casting roll and the given reference location.

The apparatus for continuously casting strip may also have separate location sensors capable of sensing the position of the casting rolls relative to the given reference location at each end of each casting roll independently.

The apparatus for continuously casting strip may further include force sensors capable of sensing the forces exerted on the strip adjacent the nip and producing electrical signals indicative of forces exerted on the strip. The control system may be also capable of receiving the electrical signals indicative of the sensed forces exerted on the strip and causing the actuator to move the casting rolls responsive to the sensed forces exerted on the strip as desired.

The control system may capable of receiving and combining the separate electrical signals indicative of the sensed forces exerted on the strip from each end of each casting roll, and causing one or more actuators to vary the position of the casting rolls responsive to the combined electrical signals. Alternately or in addition, the control system may be capable of receiving the electrical signals indicative of the sensed forces exerted on the strip and combining the electrical signals from an end of one casting roll with the electrical signals from the corresponding end of the other casting roll and causing one or more actuators to vary the position of the casting rolls responsive to the combined electrical signals. Alternately or in addition, the control system may be capable of receiving the electrical signals indicative of the sensed forces exerted on the strip and combining the electrical signals from opposite ends of one casting roll and causing the actuators to vary the position of the casting rolls responsive to the combined electrical signals.

The apparatus for continuously casting strip may also include profile sensors positioned downstream of the nip capable of sensing the strip thickness profile at a plurality of locations along the strip width and producing electrical signals indicative of the strip thickness profile downstream of the nip, and the control system capable of processing the electrical signals indicative of the strip thickness profile and causing the actuator to move the casting rolls responsive to the electrical signals and further control the thickness profile of the cast strip responsive to the electrical signals indicative of the strip thickness profile.

Further, the apparatus for continuously casting strip may include temperature profile sensors positioned downstream of the nip capable of sensing the strip temperature profile at a plurality of locations along the strip width, and producing electrical signals indicative of the strip temperature profile downstream of the nip. The temperature profile sensors may be positioned to determine the temperatures across the cast strip at segments adjacent the nip or further downstream of the nip, and generate electrical signals corresponding to the strip temperature profile in segments across the strip adjacent the nip. Then, the control system may be capable of processing the electrical signals indicative of the strip temperature profile, and causing the actuators to move the casting rolls and further control the thickness profile of the cast strip responsive to the electrical signals indicative of the strip temperature profile.

Also disclosed is a method of continuously casting metal strip comprising the steps of:

(a) assembling a pair of counter-rotatable casting rolls having casting surfaces laterally positioned to form a nip there between through which thin cast strip can be cast, and on which a casting pool of molten metal can be formed supported on the casting surfaces above the nip, (b) sensing the location of each casting roll relative to a given reference location and producing electrical signals indicative of each casting roll position in relation to the given reference location, (c) controlling the location of each casting roll independently responsive to the electrical signals indicative of the position of the casting rolls, and (d) moving each casting roll independently toward and away from the given reference location as desired.

Each casting roll may be mounted on a roll cassette, with each casting roll being mounted to be capable of moving toward and away from the nip during casting.

The method may include the step of separately moving each casting roll relative to the given reference location. Alternately or in addition, the method may further include the steps of:

sensing the forces exerted on the strip adjacent the nip at each end of each casting roll and producing electrical signals indicative of force exerted on the strip at each end of each casting roll; and causing actuators to move each end of each casting roll responsive to the electrical signals indicative of the forces exerted on the strip to vary the distance between each end of the casting roll and the given reference location as desired.

In the method, the moving step may be performed by one or more actuators. However, generally two or more actuators are desired to independently move the casting rolls in relation to the given reference location. In any event, the actuator or actuators are selected from the group consisting of servomechanisms, hydraulic mechanisms, pneumatic mechanisms, rotating actuators, and magnetostrictive actuators, and are capable of moving the casting rolls independently to vary the distance between each casting roll and the given reference location. The moving step may be performed by independently varying the distance between the casting rolls at each end of the casting rolls. Alternately or in addition, the moving step is performed by controlling a force urging each roll against the thin cast strip there between during casting. The method may include the additional step of disconnecting the casting rolls to enable the casting rolls to be changed out without dismantling the actuators.

DETAILED DESCRIPTION OF THE DRAWINGS

Figure 1:
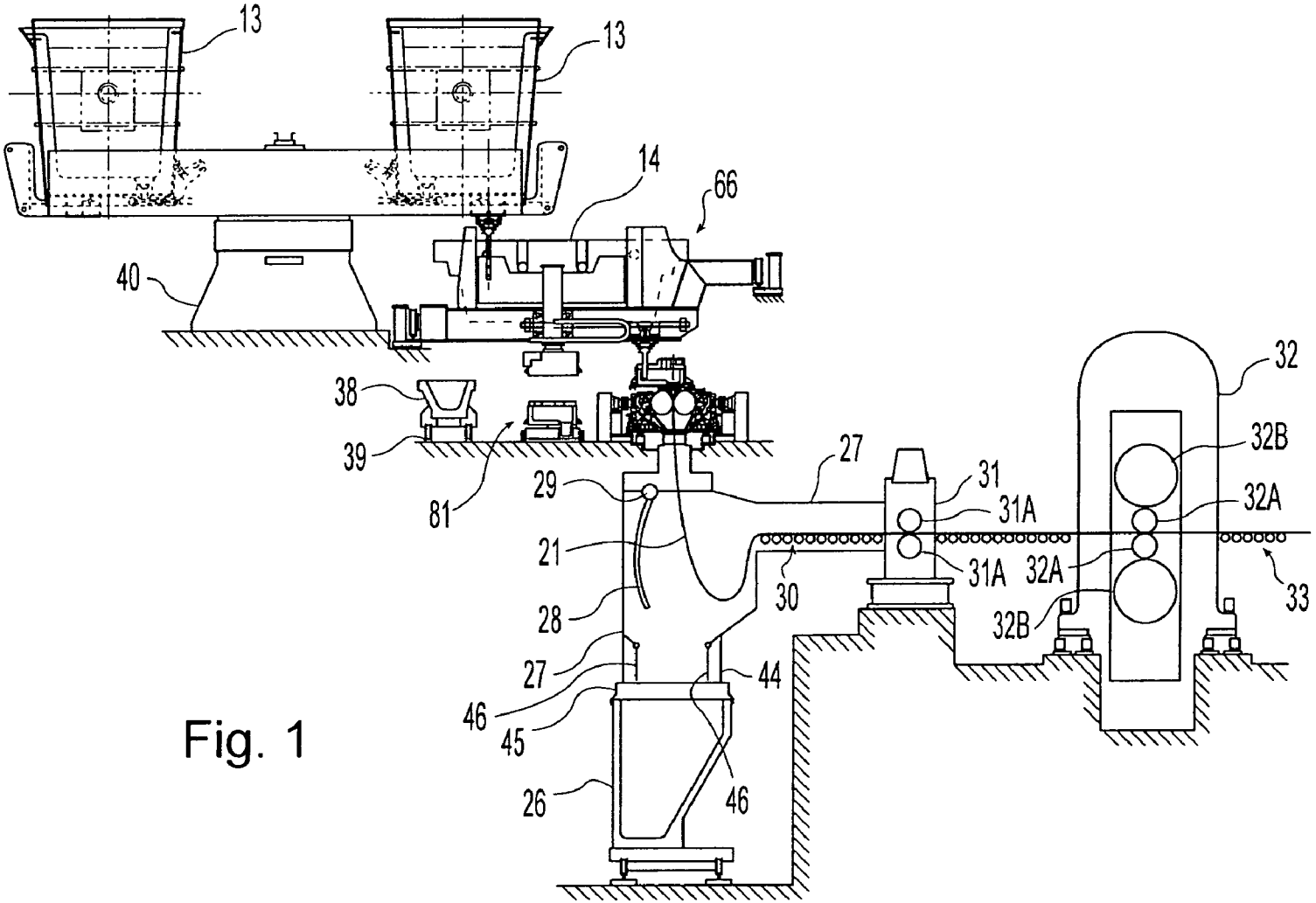
FIG. 1 is a diagrammatical side view of a twin roll caster of the present disclosure.

Referring now to FIGS. 1 through 7, a twin roll caster is illustrated that comprises a main machine frame 10 that stands up from the factory floor and supports a pair of casting rolls mounted in a module in a roll cassette 11. The casting rolls 12 are mounted in the roll cassette 11 for ease of operation and movement as described below. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls as described herein.

The casting apparatus for continuously casting thin steel strip includes a pair of counter-rotatable casting rolls 12 having casting surfaces 12A laterally positioned to form a nip 18 there between. Molten metal is supplied from a ladle 13 through a metal delivery system to a metal delivery nozzle 17, or core nozzle, positioned between the casting rolls 12 above the nip 18. Molten metal thus delivered forms a casting pool 19 of molten metal above the nip supported on the casting surfaces 12A of the casting rolls 12. This casting pool 19 is confined in the casting area at the ends of the casting rolls 12 by a pair of side closures or side dam plates 20 (shown in dotted line in FIG. 3). The upper surface of the casting pool 19 (generally referred to as the "meniscus" level) may rise above the lower end of the delivery nozzle 17 so that the lower end of the delivery nozzle is immersed within the casting pool. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station 69, where the tundish is heated to near a casting temperature, to the casting position. A tundish guide 70 positioned beneath the tundish car 66 to enable moving the movable tundish 14 from the heating station 69 to the casting position.

Figure 11:
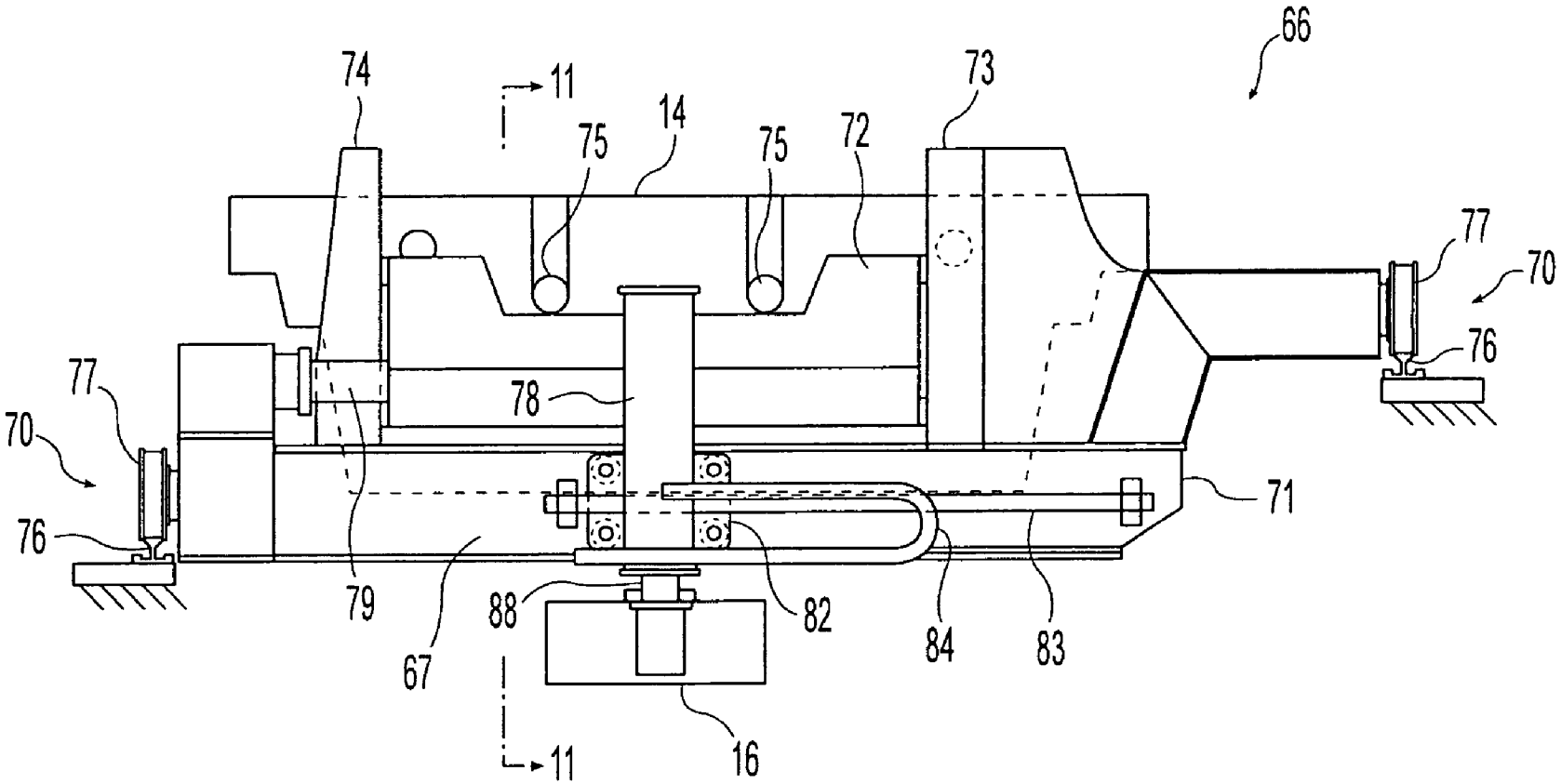
FIG. 11 is a diagrammatical side view of a movable tundish of the present disclosure.
Figure 12:
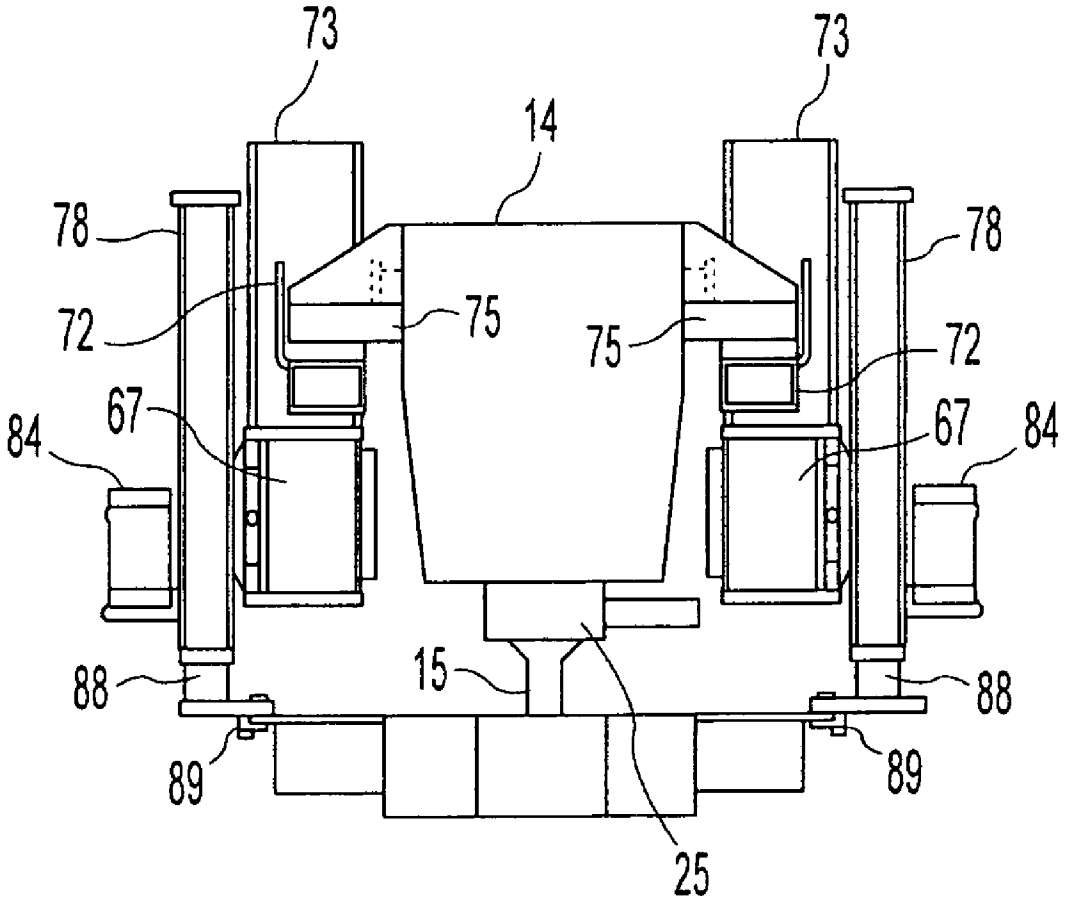
FIG. 12 is a diagrammatical end view of the movable tundish of FIG. 11.
Figure 13:
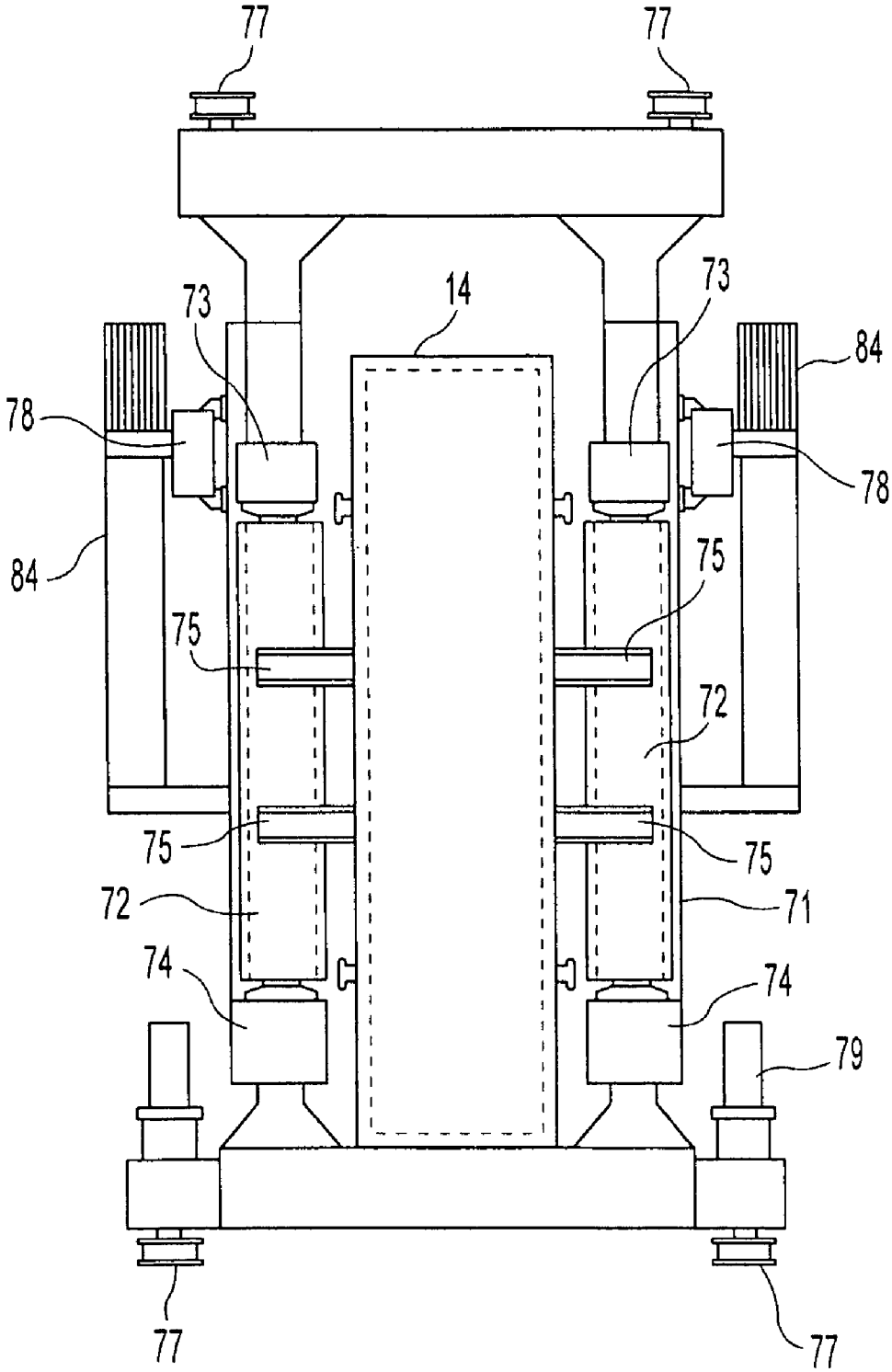
FIG. 13 is a diagrammatical plan view of the movable tundish of FIG. 11.

As shown in FIGS. 11 through 13, the tundish car 66 may include a frame 71 having a tundish support beam 72 engaging tundish arms 75 on each side of the tundish 14. The tundish support beams 72 may be positioned between lifters 73, 74 capable of raising and lowering the tundish support beam 72 and the tundish 14 relative to the frame 71 to position the tundish 14 on the tundish car 66.

Figure 2:
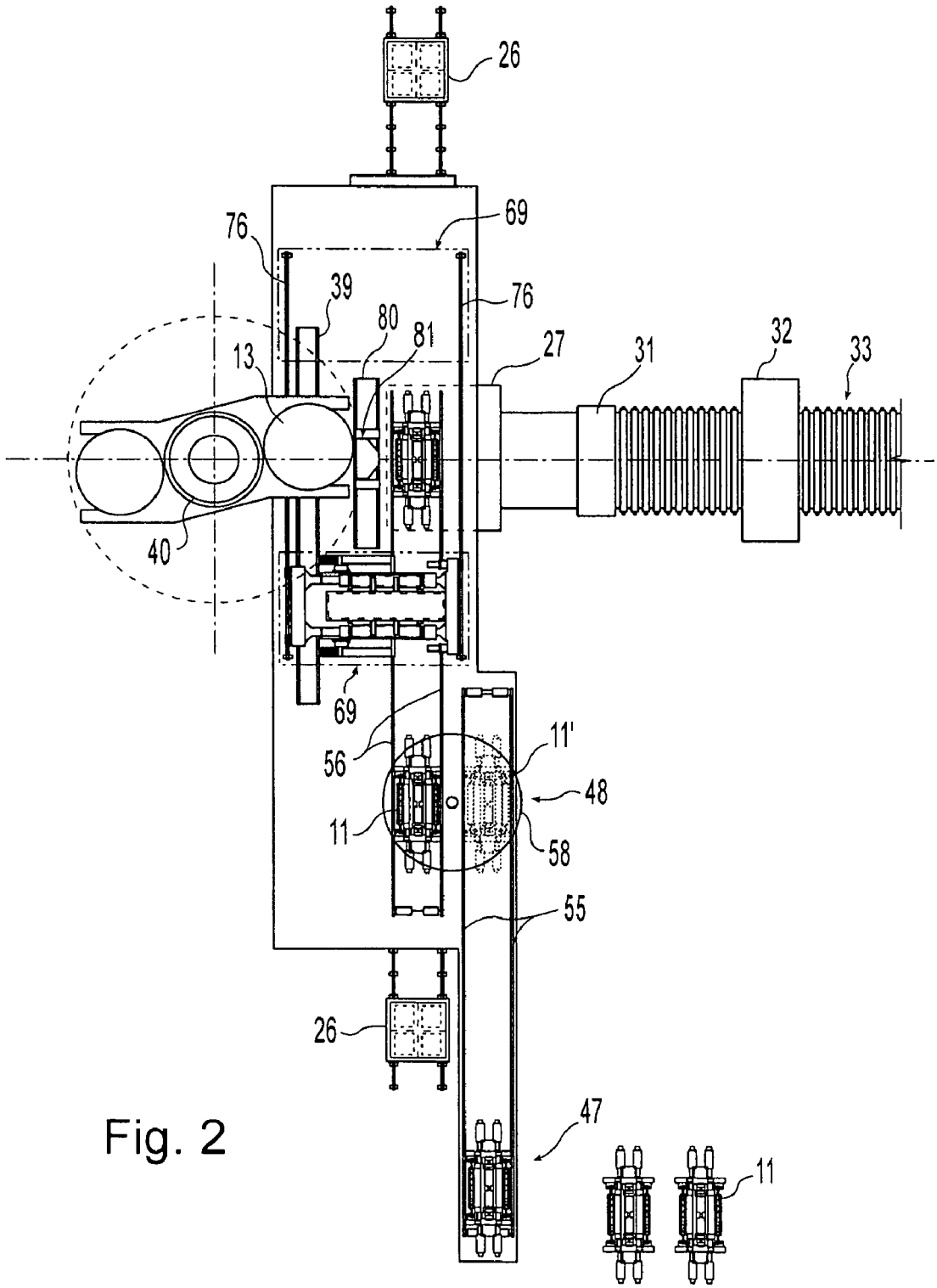
FIG. 2 is a diagrammatical plan view of the twin roll caster of FIG. 1.

The tundish guide may include rails 76 extending between the heating station and the casting position, and the tundish car 66 may include wheels 77 assembled to move on the rails 76. One or more drive motors 79 may be used to drive the wheels 77 along the rails. As shown in FIG. 2, the rails 76 may extend between two heating stations 69 in either direction away from the casting position, and capable of supporting two tundish cars 66, so that one tundish car may be in one of the heating stations 69 while another tundish car is in the casting position. After casting is stopped, the tundish 14 in the casting position may be moved on the first tundish car in the direction away from the second tundish car to its respective heating station. The tundish car typically moves between the casting position to the heating station at an elevation above the casting rolls 12 mounted in roll cassette 11, and at least a portion of the tundish guide 70 may be overhead from the elevation of the casting rolls 12 mounted on roll cassette 11 for movement of the tundish between the heating station and the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces move into contact with and through the casting pool 19 with each revolution of the casting rolls 12. The shells are brought together at the nip 18 between the casting rolls to produce a solidified thin cast strip product 21 delivered downwardly from the nip. FIG. 1 shows the twin roll caster producing the thin cast strip 21, which passes across a guide table 30 to a pinch roll stand 31, comprising pinch rolls 31A. Upon exiting the pinch roll stand 31, the thin cast strip may pass through a hot rolling mill 32, comprising a pair of reduction rolls 32A and backing rolls 32B, where the cast strip is hot rolled to reduce the strip to a desired thickness, improve the strip surface, and improve the strip flatness. The rolled strip then passes onto a run-out table 33, where it may be cooled by contact with water supplied via water jets or other suitable means, not shown, and by convection and radiation. In any event, the rolled strip may then pass through a second pinch roll stand (not shown) to provide tension of the strip, and then to a coiler.

At the start of the casting operation, a short length of imperfect strip is typically produced as casting conditions stabilize. After continuous casting is established, the casting rolls are moved apart slightly and then brought together again to cause this leading end of the strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls in enclosure 27 before it passes to the guide table 30 where it engages a succession of guide rollers.

An overflow container 38 may be provided beneath the movable tundish 14 to receive molten material that may spill from the tundish. As shown in FIGS. 1 and 2, the overflow container 38 may be movable on rails 39 or another guide such that the overflow container 38 may be placed beneath the movable tundish 14 as desired in casting locations. Additionally, an overflow container may be provided for the distributor 16 adjacent the distributor (not shown).

The sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

Figure 10:
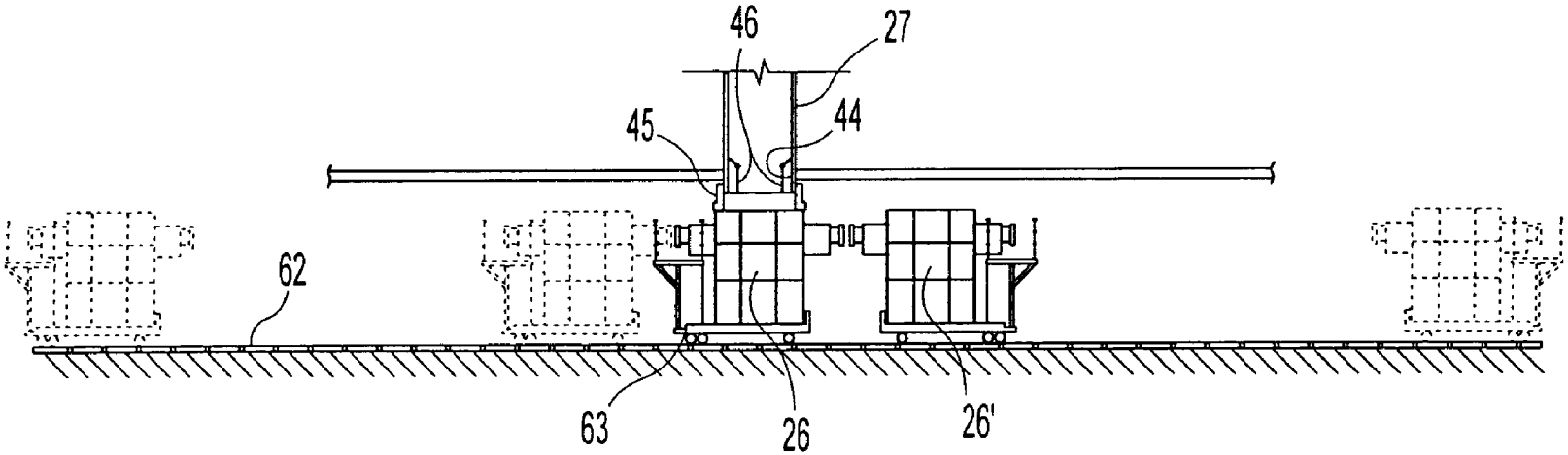
FIG. 10 is a diagrammatical partial side view of the scrap receptacle guide and scrap receptacles.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 is in selective engagement with the upper edges of the scrap receptacle 26, which is illustratively in a rectangular form, so that the scrap receptacle may be in sealing engagement with the enclosure 27. As shown in FIGS. 1 and 10, the rim portion may be movable away from or otherwise disengage from the scrap receptacle to disengage the seal and allow the scrap receptacle to move from the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position.

Figure 4:
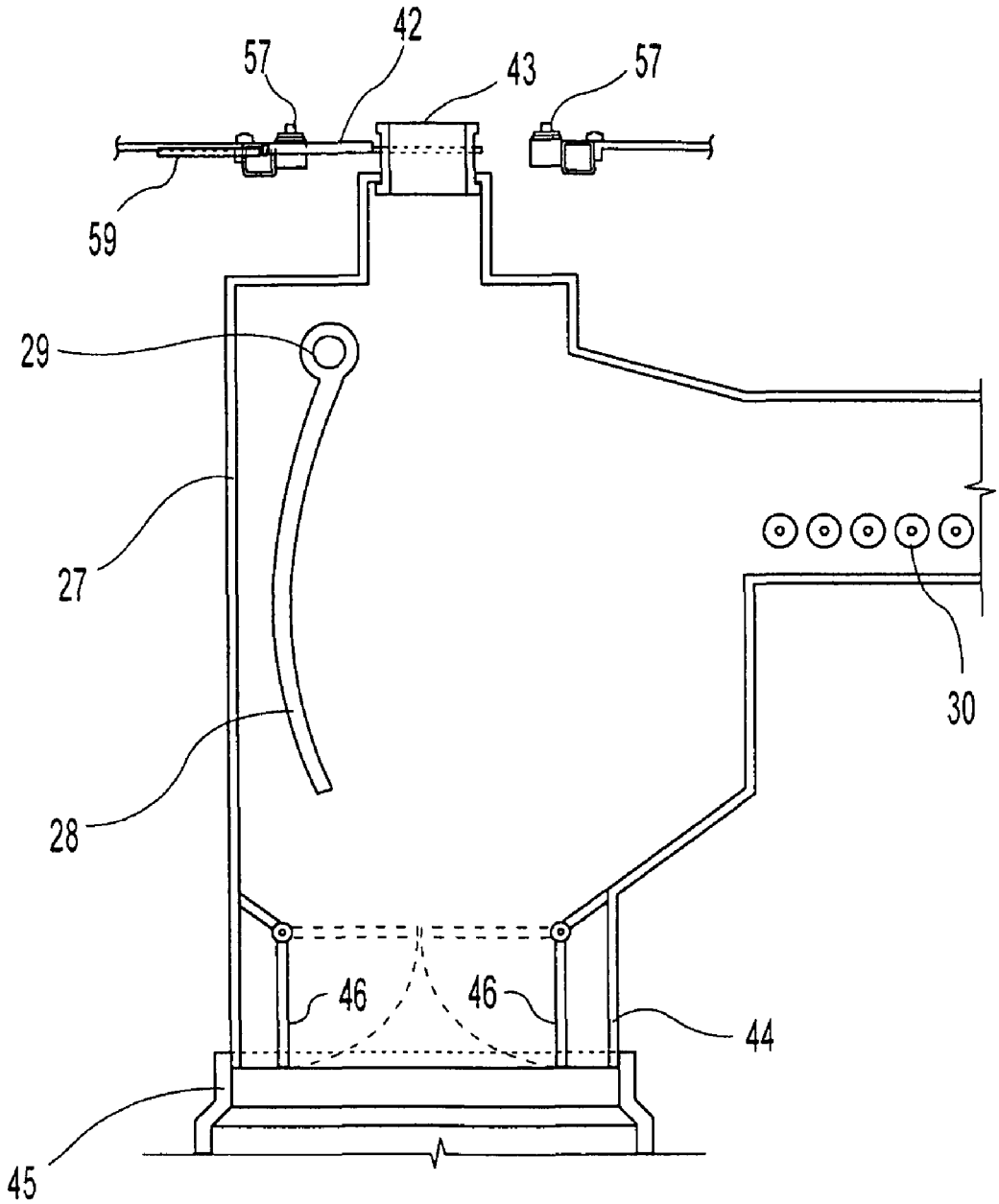
FIG. 4 is a partial sectional view of an enclosure of the twin roll caster of FIG. 1.

A lower plate 46 may be operatively positioned within or adjacent the lower enclosure portion 44 to permit further control of the atmosphere within the enclosure when the scrap receptacle 26 is moved from the scrap receiving position and provide an opportunity to continue casting while the scrap receptacle is being changed for another. The lower plate 46 may be operatively positioned within the enclosure 27 capable of closing the opening of the lower portion of the enclosure, or lower enclosure portion 44, when the rim portion 45 is disengaged from the scrap receptacle. Then, the lower plate 46 may be retracted when the rim portion 45 sealingly engages the scrap receptacle to enable scrap material to pass downwardly through the enclosure 27 into the scrap receptacle 26. As shown in FIGS. 1 and 4, the lower plate 46 may be in two plate portions, pivotably mounted to move between a retracted position and a closed position. Alternately, the lower plate 46 may be one moveable plate portion. A plurality of actuators (not shown) such as servo-mechanisms, hydraulic mechanisms, pneumatic mechanisms and rotating actuators may be suitably positioned outside of the enclosure 27, and capable of moving the lower plate in whatever configuration between a closed position and a retracted position. The plurality of actuators may be provided to rotate the lower plate 46 about a pivot. Alternately, the lower plate 46 may be movable laterally along a guide, such as one or more rails between a closed position closing the lower enclosure portion 44 and a retracted position enabling scrap material to pass downwardly through the enclosure 27 into the scrap receptacle 26.

As shown in FIG. 10, a scrap receptacle is placed beneath the casting position in the scrap receiving position to receive scrap and other by-products of the casting process in the receptacle during casting. When the scrap receptacle 26 is in the scrap receiving position, the rim portion 45 of the enclosure wall is in sealing engagement with the upper edges of the scrap receptacle 26 and the lower plate 46 is retracted. The rim portion 45 engages a portion of the scrap receptacle 26, sealingly engaging the enclosure 27. When sealed, the enclosure 27 and scrap receptacle 26 are filled with a desired gas, such as nitrogen, to reduce the amount of oxygen in the enclosure and provide a protective atmosphere for the cast strip.

Figure 3:
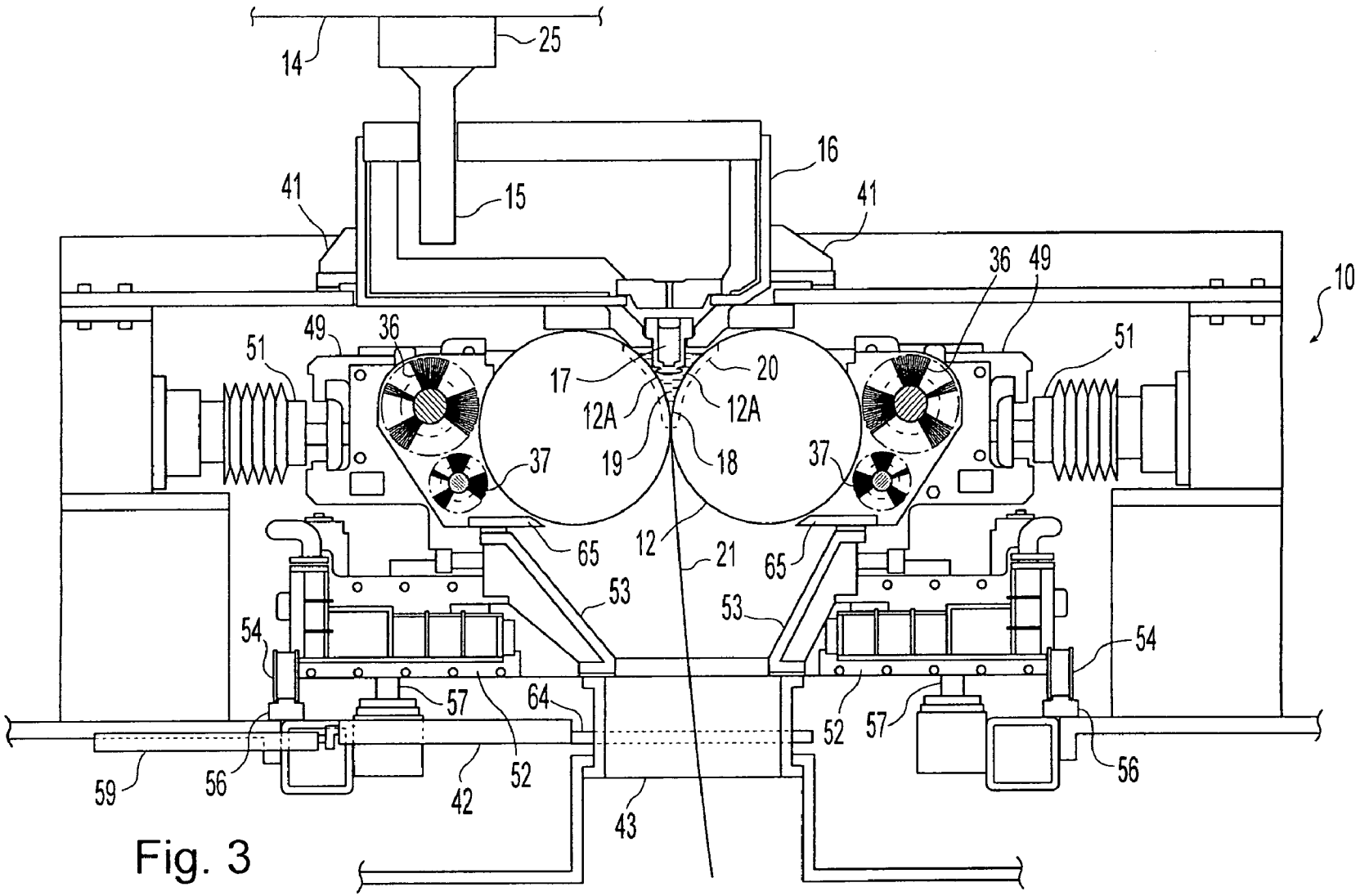
FIG. 3 is a partial sectional view through a pair of casting rolls mounted in a roll cassette of the present disclosure.
Figure 7:
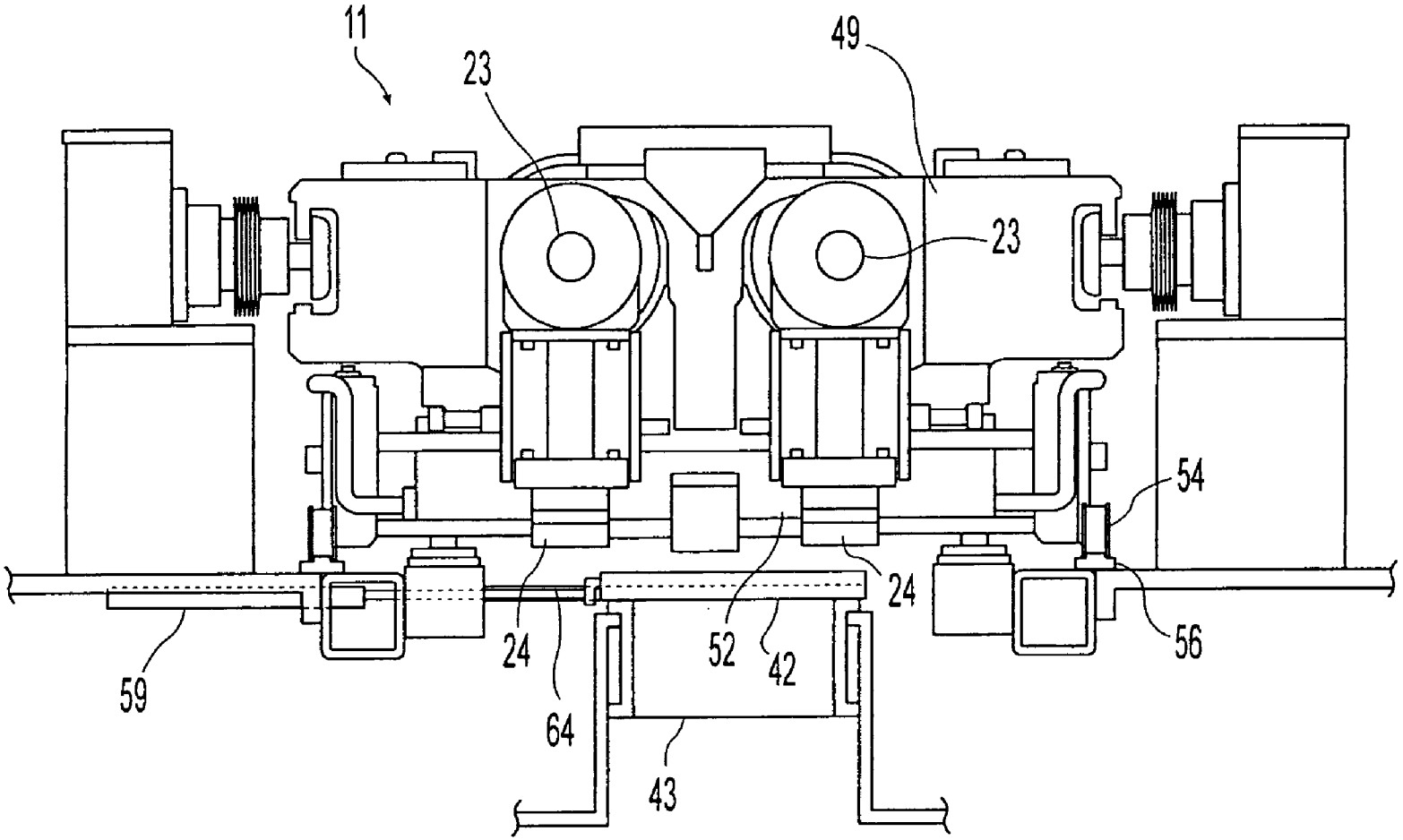
FIG. 7 is a diagrammatical end view of the roll cassette of FIG. 3.

The enclosure 27 may include an upper collar portion 43 supporting a protective atmosphere immediately beneath the casting rolls in the casting position. As shown in FIGS. 3 and 7, the upper collar portion 43 may be moved between an extended position capable of supporting the protective atmosphere immediately beneath the casting rolls and an open position enabling an upper cover 42 to cover the upper portion of the enclosure 27. When the roll cassette 11 is in the casting position, the upper collar portion 43 is moved to the extended position closing the space between a housing portion 53 adjacent the casting rolls 12, as shown in FIG. 3, and the enclosure 27. The upper collar portion 43 may be provided within or adjacent the enclosure 27 and adjacent the casting rolls, and may be moved by a plurality of actuators (not shown) such as servo-mechanisms, hydraulic mechanisms, pneumatic mechanisms, and rotating actuators. The actuators are positioned outside of the enclosure 27 and capable of moving the upper collar portion 43 between an extended and an open position. The upper collar portion 43 may be raised into the extended position in sealing engagement with the housing portion 53, which may or may not be part of the roll cassette 11, and be able to support the protective atmosphere in enclosure 27 immediately beneath the casting rolls in the casting position. The upper collar portion 43 may also be lowered into the open position disengaged from housing portion 53 enabling the upper cover 42 to move into its closed position beneath the casting rolls and covering the upper portion of the enclosure 27 as described below. The upper collar portion 43 may be water cooled.

The upper cover 42 may be operatively moved into closed position at the upper portion of the enclosure 27 beneath the casting rolls to permit further control of the protective atmosphere within the enclosure when the casting rolls are removed from the casting position. The upper cover 42 may be operably positioned within or adjacent the upper portion of the enclosure 27 capable of moving between a closed position covering the enclosure and a retracted position enabling cast strip to be cast downwardly from the nip into the enclosure 27. When the upper cover 42 is in the closed position, the roll cassette 11 may be moved from the casting position without significant loss of the protective atmosphere in the enclosure. This enables a rapid exchange of casting rolls, with the roll cassette, since closing the upper cover 42 enables the protective atmosphere in the enclosure to be preserved so that it does not have to be replaced.

One or more actuators 59, such as servo-mechanisms, hydraulic mechanisms, pneumatic mechanisms, and rotating actuators, may be provided to move the upper cover 42 between the closed position and open position. As shown in FIG. 7, the upper cover in the closed position enables the roll cassette 11 to be moved from the casting position without substantial degradation of the protective atmosphere in the enclosure 27. The upper cover may then be retracted when the casting rolls, typically in the roll cassette 11, are to be moved into the casting position, and the upper collar portion 43 moved to its extended position to support the protective atmosphere in the enclosure 27, as shown in FIG. 3, so that cast strip may be cast downwardly from the nip between the casting rolls and pass into the enclosure 27. As shown in FIGS. 3 and 7, the upper cover 42 may be capable of engaging the upper collar portion 43 and closing the enclosure 27. Alternately, the upper cover 42 may be in two or more portions capable of closing the enclosure 27. The upper cover 42 may be movable laterally along guides, such as a pair of rails 64 as shown in FIGS. 3 and 7, and the actuator 59 capable of moving the upper cover along the guides between the closed position and the retracted position. Alternately the upper cover 42 may rotated about a pivot, or with other motion, to move between a retracted position and a closed position. In any case, the actuator 59 is capable of moving the upper cover between the closed position and the retracted position.

Figure 8:
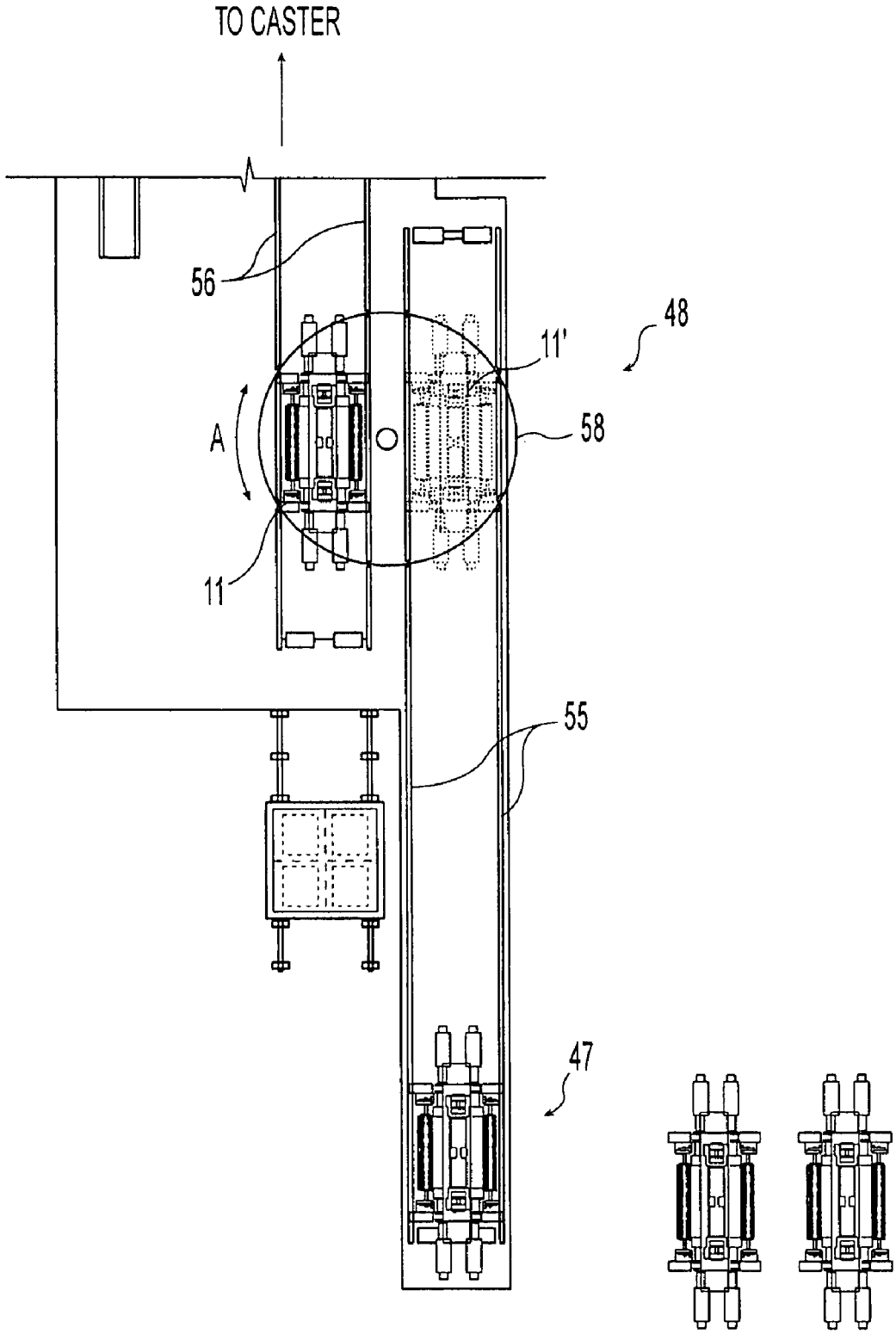
FIG. 8 is a diagrammatical plan view of a roll cassette transfer station and a set-up station of the present disclosure.
Figure 9:
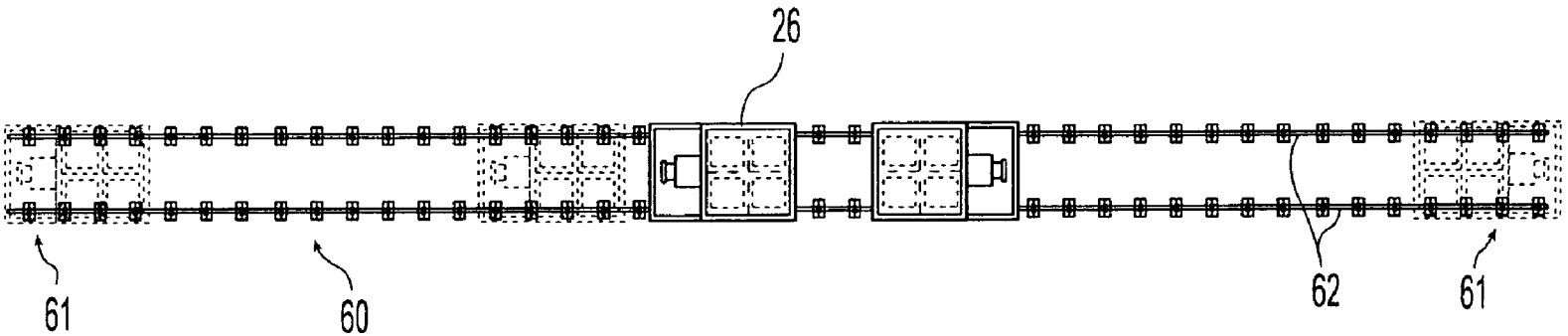
FIG. 9 is a diagrammatical plan view of a scrap receptacle guide.

The casting rolls 12 mounted in roll cassette 11 are capable of being transferred from a set up station 47 to a casting position through a transfer station 48, as shown in FIGS. 2 and 8. The casting rolls 12 may be assembled into the roll cassette 11 and then moved to the set up station 47, where at the set up station the casting rolls mounted in the roll cassette are capable of being prepared for casting. At the transfer station 48, casting rolls mounted in roll cassettes are capable of being exchanged, and in the casting position the casting rolls mounted in the roll cassette are operational in the caster. A casting roll guide is adapted to enable the transfer of the casting rolls mounted in the roll cassette between the set up station and the transfer station, and between the transfer station and the casting position. The casting rolls mounted in a roll cassette may be raised or lowered into the casting position.

The casting roll guides may comprise rails on which the casting rolls 12 mounted in the roll cassette 11 are capable of being moved between the set up station and the casting position through the transfer station. First rails 55 may extend between the set up station 47 to the transfer station 48, and second rails 56 may extend between the transfer station 48 to the casting position. The second rails 56 may extend to the casting position from either side of the casting position. Alternately, the second rails 56 may extend from the casting position in two directions with a second transfer station and a second setup station with rails corresponding to the first rail from both setup stations to the transfer station, such that the casting rolls 12 mounted in roll cassettes 11 may arrive in the casting position from either of two directions. Thus the casting roll guides may move casting rolls mounted in the roll cassette from either transfer station to the casting position at substantially the same elevation as the casting rolls when in the casting position. Alternately or in addition, the casting roll guides may move the casting rolls mounted in the roll cassette from the set up station to the transfer station at substantially the same elevation or different elevations. In one alternate, the first rails 55 are at a different elevation than the second rails 56, and the transfer station 48 may move between the different elevations to move casting rolls 12 mounted in roll cassettes 11 between the first rails 55 and second rails 56.

In any case, the casting roll guides may be, if needed, enable locking engagement of positioning assemblies with the roll cassette 11 on the casting roll guides. In one embodiment, the roll cassette 11 may include wheels 54 capable of supporting and moving the roll cassette on the rails 55, 56. As shown in FIGS. 3 and 7, the wheels 54 may have a portion that engages the rail to enable to the wheel to stay on the rail. Alternately or in addition, the rail may have a portion that engages the wheel to enable the wheel to stay on the rail.

The casting roll guides may include a propulsion system (not shown) capable of moving the roll cassette 11 along the rails 55, 56. Additionally, the roll cassette 11 may include at least a portion of the propulsion system capable of moving the roll cassette 11, the portion capable of driving the wheels 54 or capable of cooperating with a corresponding portion of the propulsion device of the casting roll guide. The propulsion system may include, for example, cog and drive chain, pulley and cable, drive screw and screw jack, rack and pinion, linear actuators, hydraulic or pneumatic cylinders, hydraulic or pneumatic actuators, electric motors, or other devices capable of moving the roll cassette 11 along the rails 55, 56.

The casting rolls mounted in the roll cassette are capable of being prepared for casting at the set up station 47. Initial casting roll position on the roll cassette and other adjustments may be made when the casting rolls are prepared for casting. The set up station 47 may be position on the first rails 55. Alternately, the set up station 47 may be separate from the first rails 55 and at the same or a different elevation than the first rails 55.

As shown in FIGS. 2 and 8, the transfer station 48 may include a turntable 58. Both first and second rails 55, 56 may be capable of being aligned with rails on the turntable 58 of the transfer station such that the turntable 58 may be turned to exchange casting rolls mounted in roll cassettes between the first rails 55 and the second rails 56. The turntable 58 may rotate about a center axis, as indicated by arrow "A" in FIG. 8, to transfer a roll cassette from one set of rails to another. As shown in FIG. 8, the turntable 58 may include at least two rail portions, each capable of holding a set of casting rolls mounted a roll cassette and each aligned with a set of rails 55, 56 extending there from, such that when the turntable rotates about its central axis, the casting rolls mounted on the roll cassettes on the turntable move from being aligned with one set of rails to another.

Thus the turntable 58 shown in FIG. 8 is generally configured to transfer two sets of casting rolls mounted on roll cassettes at the same time, but the transfer station may be configured to be capable of transferring three, or more sets of casting rolls mounted in roll cassettes as desired to service one or more twin roll casters at the same time. For example, the transfer station 48 may include a shifting platform (not shown) where both first and second rails 55, 56 may be capable of being aligned with rails on the shifting platform. In this event, the shifting platform may then translate horizontally, vertically, or laterally to move casting rolls mounted in roll cassettes between the first rails 55 and the second rails 56.

The roll cassette 11 with casting rolls may be assembled in a module for rapid installation in the caster in preparation for casting strip, and for rapid set up of the casting rolls 12 for installation. The roll cassette 11 comprises a cassette frame 52, roll chocks 49 capable of supporting the casting rolls 12 and moving the casting rolls on the cassette frame, and the housing portion 53 positioned beneath the casting rolls capable of supporting a protective atmosphere in the enclosure 27 immediately beneath the casting rolls during casting. The housing portion 53 is positioned corresponding to and sealingly engaging an upper portion of the enclosure 27 for enclosing the cast strip below the nip.

A roll chock positioning system is provided on the main machine frame 10 having two pairs of positioning assemblies 51 that can be rapidly connected to the roll cassette adapted to enable movement of the casting rolls on the cassette frame 52, and provide forces resisting separation of the casting rolls during casting. The positioning assemblies 51 may include actuators such as mechanical roll biasing units or servomechanisms, hydraulic or pneumatic cylinders or mechanisms, linear actuators, rotating actuators, magnetostrictive actuators or other devices for enabling movement of the casting rolls and resisting separation of the casting rolls during casting.

Figure 14:
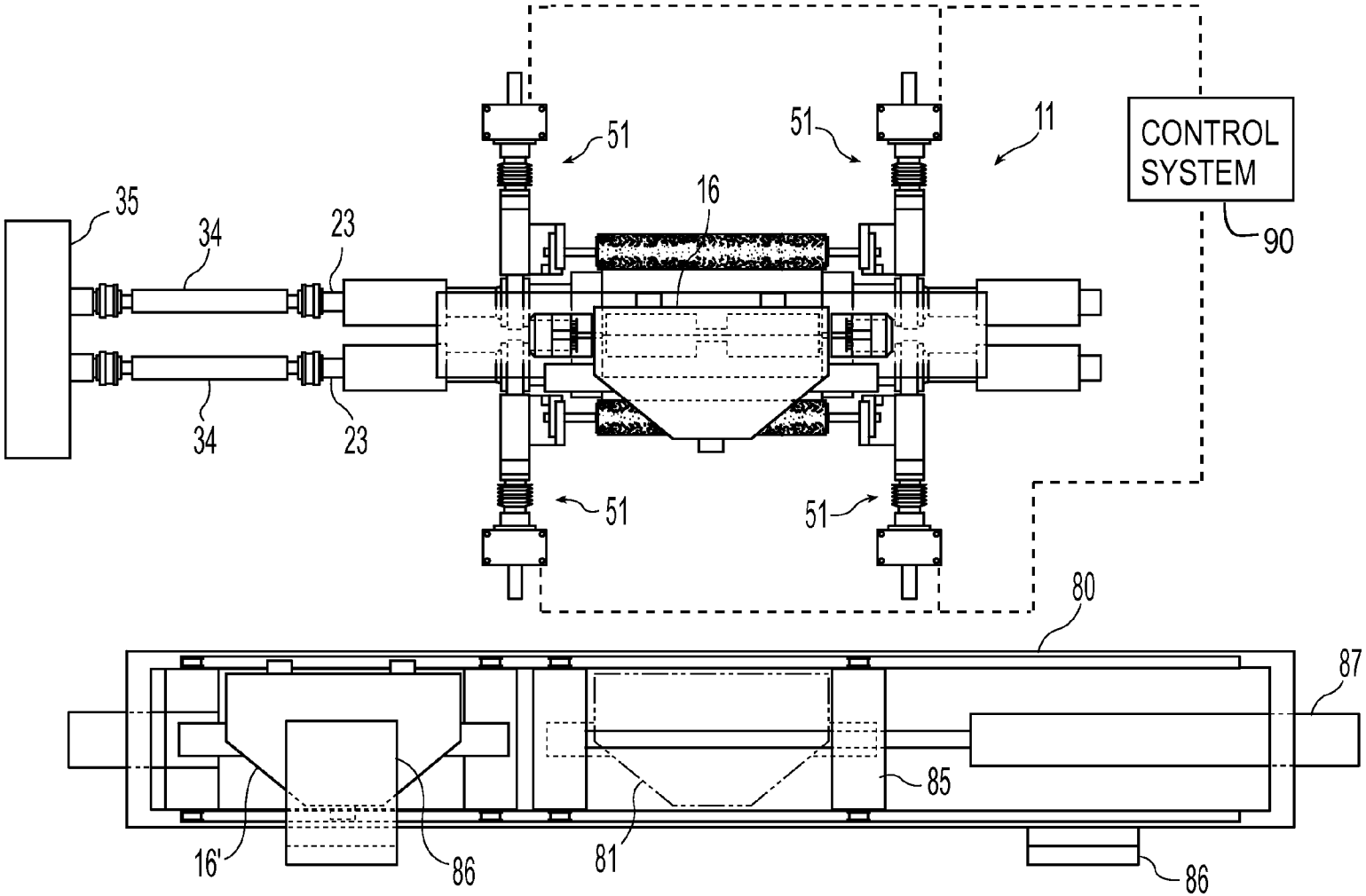
FIG. 14 is a diagrammatical plan view of casting rolls mounted in a roll cassette in a casting position and a distributor shift car.

The casting rolls 12 include shaft portions 22, which are connected to drive shafts 34, best viewed in FIG. 14, through end couplings 23. The casting rolls 12 are counter-rotated through the drive shafts by an electric motor (not shown) and transmission 35 mounted on the main machine frame. The drive shafts can be disconnected from the end couplings 23 when the cassette is to be removed enabling the casting rolls to be changed without dismantling the actuators of the positioning assemblies 51. The casting rolls 12 have copper peripheral walls formed with an internal series of longitudinally extending and circumferentially spaced water cooling passages, supplied with cooling water through the roll ends from water supply ducts in the shaft portions 22, which are connected to water supply hoses 24 through rotary joints (not shown). The casting rolls 12 may be about 500 millimeters in diameter, or may be up to 1200 millimeters or more in diameter. The length of the casting rolls 12 may be up to about 2000 millimeters, or longer, in order to enable production of strip product of about 2000 millimeters width, or wider, as desired in order to produce strip product approximately the width of the rolls. Additionally, the casting surfaces may be textured with a distribution of discrete projections, for example, as random discrete projections as described and claimed in U.S. Pat. No. 7,073,565. The casting surface may be coated with chrome, nickel, or other coating material to protect the texture.

Figure 5:
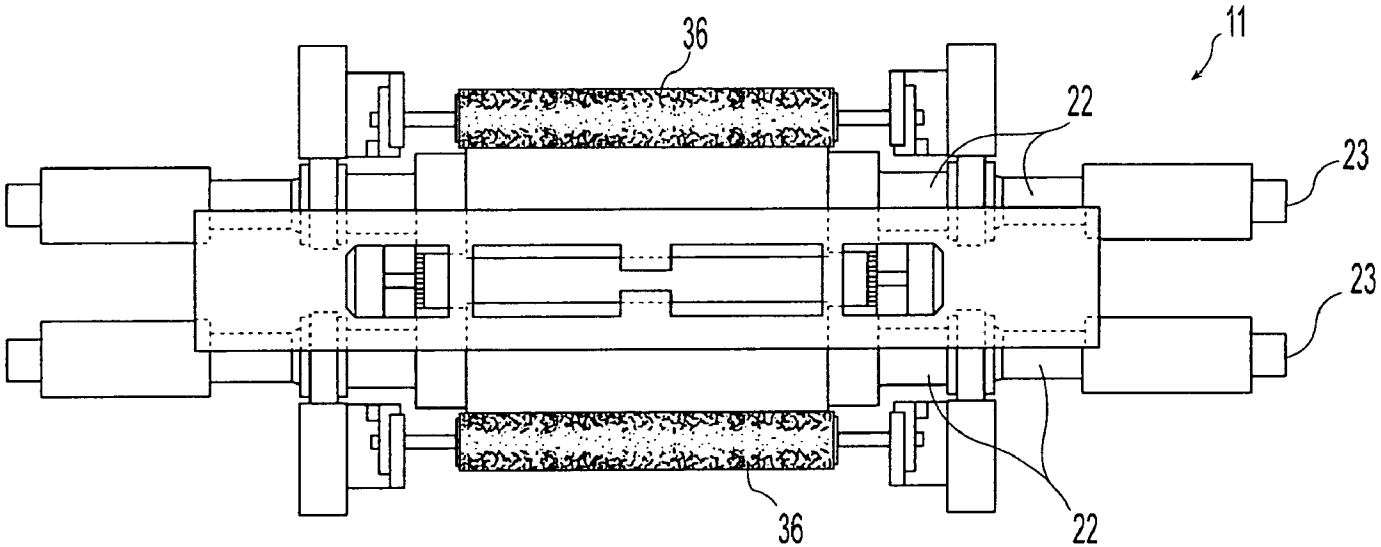
FIG. 5 is a diagrammatical plan view of the roll cassette of FIG. 3 removed from the caster.
Figure 6:
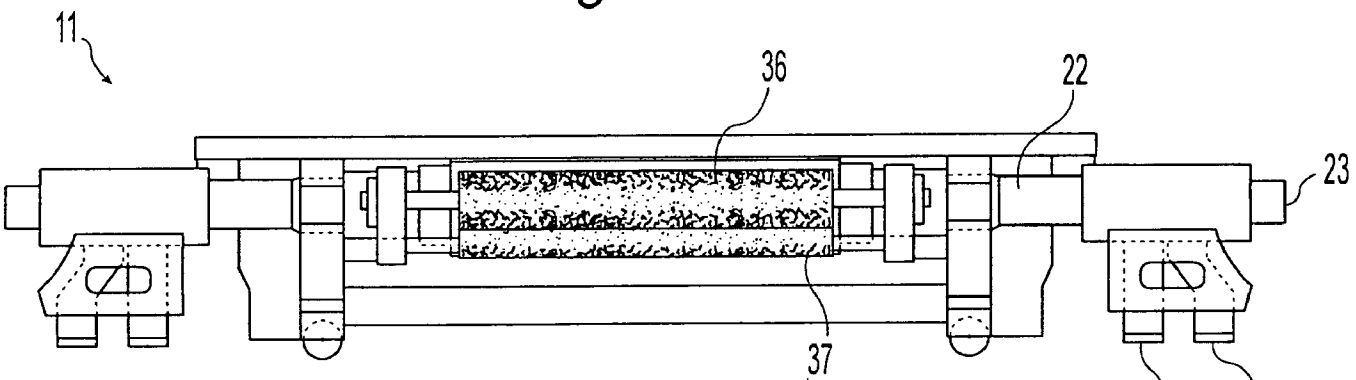
FIG. 6 is a diagrammatical side view of the roll cassette of FIG. 3 removed from the caster.

As shown in FIGS. 3 and 5, cleaning brushes 36 are disposed adjacent the pair of casting rolls, such that the periphery of the cleaning brushes 36 may be brought into contact with the casting surfaces 12A of the casting rolls 12 to clean oxides from the casting surfaces during casting. The cleaning brushes 36 are positioned at opposite sides of the casting area adjacent the casting rolls, between the nip 18 and the casting area where the casting rolls enter the protective atmosphere in contact with the molten metal casting pool 19. Optionally, a separate sweeper brush 37 may be provided for further cleaning the casting surfaces 12A of the casting rolls 12, for example at the beginning and end of a casting campaign as desired.

A knife seal 65 may be provided adjacent each casting roll 12 and adjoining the housing portion 53. The knife seals 65 may be positioned as desired near the casting roll and forming a partial closure between the housing portion 53 and the rotating casting rolls 12. The knife seals 65 enable control of the atmosphere around the brushes, and reduce the passage of hot gases from the enclosure 27 around the casting rolls. The knife seals 65 may be positioned 3 to 4 millimeters from the casting surface 12A, as desired, when in casting position. The position of each knife seal 65 may be adjustable during casting by causing actuators such as hydraulic or pneumatic cylinders to move the knife seal toward or away from the casting rolls. Alternately, the knife seals 65 may be positioned prior to casting and not adjustable during casting.

Once the roll cassette 11 is in the casting position in the caster, the casting rolls 12 are moved into an operating position for casting thin strip. This movement of the casting rolls into operating position may be by raising, lowering or lateral motion of the casting rolls 12. This movement of the casting rolls 12 into operating position may be by movement of the casting rolls 12 and the roll cassette 11 as a unit, or by moving the casting rolls 12 separate from at least part of roll cassette 11. This movement in operating position will generally depend on the particular embodiment desired, but the movement will be generally as little as practical so as to reduce motion and time in getting the casting rolls into operating position. The operating position may be as the casting rolls reach the casting position without change in elevation or lateral motion.

Once in operating position, the casing rolls are secured with the positioning assemblies 51 connected to the roll cassette 11, drive shafts connected to the end couplings 23, and a supply of cooling water coupled to water supply hoses 24. A plurality of jacks 57 may be used to further place the casting rolls in operating position. The jacks 57 may raise the roll cassette 11 in the casting position, as shown in FIG. 3. Alternately, the roll cassette may be lowered or laterally moved in the casting position to place the casting rolls in operating position. The positioning assemblies 51 may move at least one of the casting rolls 12 to provide a desired nip, or gap between the rolls in the casting position.

To control the gap between the rolls and control the casting of the strip product, each casting roll 12 is mounted in the roll cassette 11 to be capable of moving toward and away from the nip during casting. The positioning assemblies 51 include an actuator capable of moving laterally each casting roll toward and away from a given reference location as desired. Location sensors are provided capable of sensing the location of the casting rolls relative to the given reference location, and producing electrical signals indicative of each casting roll's position in relation to the given reference location. A control system 90 is provided capable of receiving the electrical signals indicative of each casting roll's position and causing the actuator to move the casting rolls into desired position for casting metal strip. The apparatus for continuously casting strip may have one or more actuators provided capable of independently moving each casting roll relative to the given reference location as desired. Typically, this is done with two or more actuators, although it may be possible to independently move each casting roll with one actuator mechanism.

Figure 15:
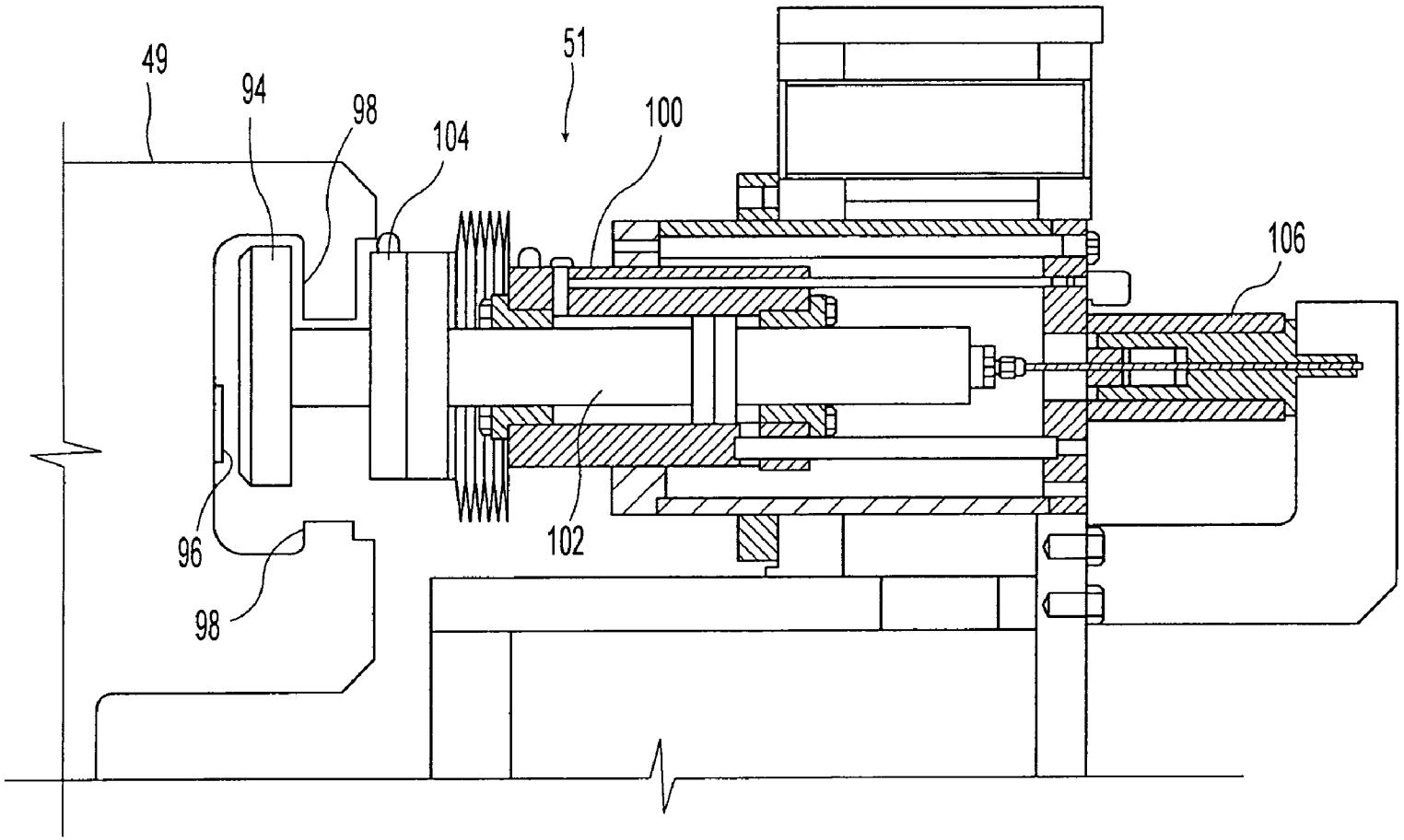
FIG. 15 is a sectional view through a first positioning assembly of the present disclosure in the retracted position of FIG. 7.
Figure 16:
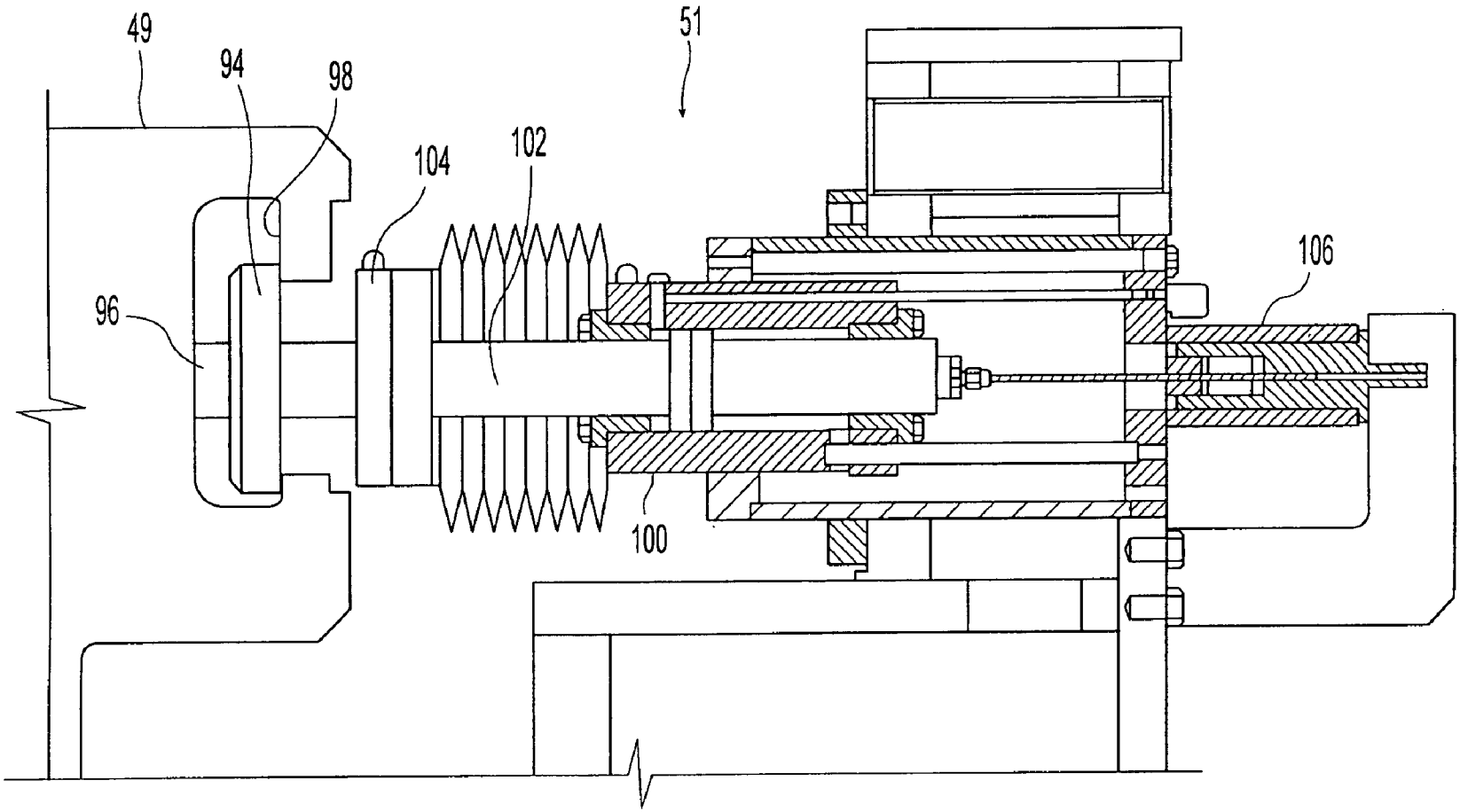
FIG. 16 is a sectional view through the positioning assembly of FIG. 15 in the extended position of FIG. 3.

As shown in FIGS. 15 and 16, positioning assembly 51 has a flange 94 capable of engaging the roll cassette 11. The positioning assembly 51 may be secured to the roll cassette in cooperation with shaft 96. The shaft 96 may be positioned by an actuator (not shown) moving in and out within the roll chock 49, and secure the positioning assembly 51 by pressing the flange 94 against a corresponding surface 98 of the roll cassette 11.

The positioning assembly 51 includes a first actuator 100. The first actuator 100 may be capable of moving a thrust element 102 in connection with the flange 94. A force sensor or load cell 104 may be positioned between the thrust element 102 and the flange 94. The load cell 104 is positioned capable of sensing forces urging the casting roll 12 against the thin cast strip casting between the casting rolls 12 and providing an electrical signal indicative of the sensed force exerted on the strip adjacent the nip.

A first location sensor 106 is provided with the positioning assembly 51 to determine the position of the thrust element 102, and thereby the position of the flange 94 and the roll chock 49 secured thereto. The first location sensor 106 provides electrical signals to the control system indicative of the position of the roll chock 49 and associated casting roll 12 relative to a given reference location.

Figure 17:
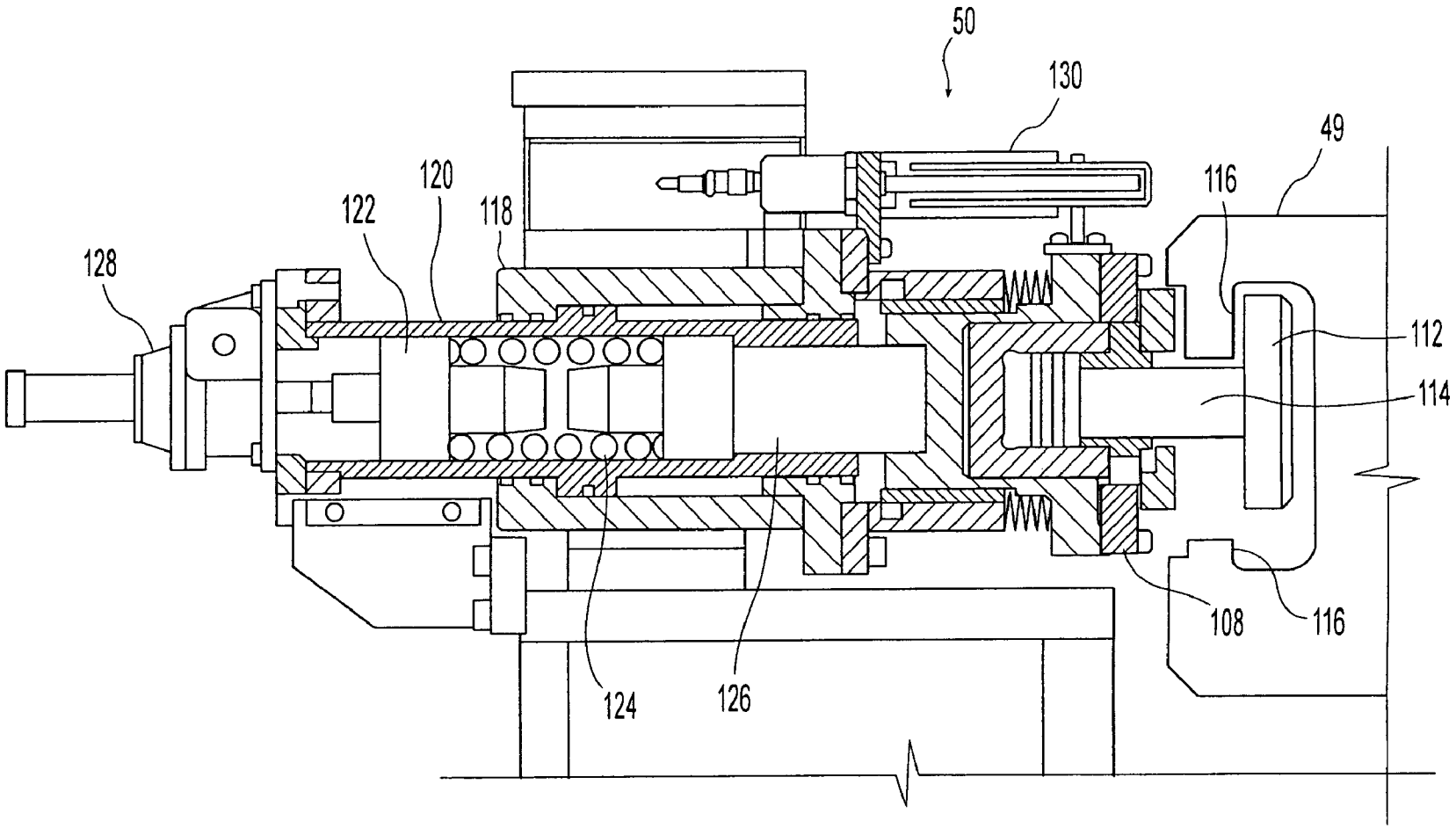
FIG. 17 is a sectional view through an alternate positioning assembly in the retracted position of FIG. 7.

Optionally, a positioning assembly 50 having a compression spring may be provided to control one of the casting rolls. As shown in FIG. 17, the positioning assembly 50 has a flange 112 capable of engaging the roll cassette 11. The positioning assembly 50 may be secured to the roll cassette by a flange cylinder 114. The flange cylinder 114 is engaged to secure the flange 112 against a corresponding surface 116 of the roll cassette 11.

If provided, the positioning assembly 50 may include a second actuator 118 capable of moving a thrust element 120 in connection with the flange 112. A force sensor or load cell 108 may be positioned between the thrust element 120 and the flange 112. The load cell 108 is positioned capable of sensing forces urging the casting roll 12 against the thin cast strip casting between the casting rolls 12 and providing an electrical signal indicative of the sensed force exerted on the strip adjacent the nip. Positioning assembly 50 may include an additional load cell capable of measuring the spring compression force.

The thrust element 120 for the positioning assembly 50 may include a spring positioning device 122, a compression spring 124 having a desired spring rate, and a slidable shaft 126 movable against the compression spring 124 within the thrust element 120. A screw jack 128 or other linear actuator may be provided capable of translating the spring positioning device 122, and thereby advancing the slidable shaft 126 and compressing the compression spring 124. The flange 112 is connected to the slidable shaft 126 and displaceable against the compression spring 124.

A second location sensor 130 may be provided with positioning assembly 50 to determine the location of the slidable shaft 126, and thereby the position of the flange 112 and the roll chock 49 secured thereto. The second position sensor 130 provides signals to the control system 90 indicating the position of the roll chock 49 and associated casting roll 12 relative to a given reference location.

The actuators 100, and optionally actuators 118, are capable of moving the casting rolls independently to vary the distance between each casting roll and the given reference location. Additionally, the actuators 100 may be capable of independently varying the distance between the casting rolls at each end of the casting rolls. By independently varying, each casting roll 12 is able to move toward and away from the reference location and the nip between the casting rolls. There are reaction forces on the casting rolls from the cast strip and the movement of the adjacent casting roll, but these reaction forces are forces to which the independent movement of the casting rolls is responsive. As shown in FIG. 14, separate actuators in positioning assemblies 51, and optionally positioning assemblies 50, may be provided at each end of each casting roll and capable of independently varying the distance between the casting rolls at each end of each casting roll as desired. The separate actuators may be provided capable of independently moving each end of each casting roll relative to the given reference location as desired.

In the past, adjustable stops were provided between the casting rolls limiting inward movement and defining the minimum width of the nip, where one casting roll was maintained against the adjustable stop and the other casting roll was capable of outward movement against resistive forces, such as against the compression spring 124 in the second actuator 118. In the present disclosure, neither casting roll is pressed against a physical stop during casting. The position of both casting rolls may be varied independently toward and away from the nip and a given reference location. In the present disclosure, stops are appropriate only as a fail safe to avoid the casting rolls from coming together and being damaged.

To control the position of the casting rolls 12, a reference location is determined, and the actuators 100, and optionally actuators 118, move each casting roll independently toward and away from the given reference location as desired. A reference location may be determined for each casting roll, with a known relationship there between. In any event, the position of each casting roll is determined relative to the given reference location, and thereby the position of each casting roll relative to the other casting roll may also be determined.

The location sensors 106, 130 are capable of sensing the location of the casting rolls 12 relative to the given reference location, and producing electrical signals indicative of each casting roll position in relation to the given reference location. Separate location sensors may be provided capable of sensing the position of the casting rolls relative to the given reference location at each end of each casting roll independently. The control system may be capable of receiving the electrical signals indicative of the position each casting roll, and causing actuators 100 to move each end of each casting roll independently to control the parallelism or wedge between the casting rolls.

The location sensors 106, 130 may be linear displacement sensors, such as for example but not limited to voltage differential transducers, variable inductance transducers, variable capacitance transducers, eddy current transducers, magnetic displacement sensors, optical displacement sensors, or other displacement sensors capable of sensing the location of the casting rolls 12 relative to the given reference location and producing electrical signals indicative of each casting roll position in relation to the given reference location.

The control system 90 may include one or more controllers, such as programmable computers, programmable microcontrollers, microprocessors, programmable logic controllers, signal processors, or other programmable controllers, which are capable of receiving electrical signals from the location sensors and force sensors, processing the electrical signals, and providing control signals capable of causing the actuators 100, and optionally actuators 118 to move as desired.

The control system 90 is capable of receiving the electrical signals indicative of the casting roll positions and causing the actuators to move the casting rolls 12 into desired position for casting metal strip. Additionally, the control system 90 may control the position of each end of each casting roll 12 independently by causing the two pair of actuators to vary independently the distance between the casting rolls at each end of the casting rolls, or to vary the distance between each end of the casting rolls and the given reference location.

Additionally, the control system controls the casting of the strip product responsive to forces exerted on the strip adjacent the nip. The force sensors or load cells 104 are capable of sensing the forces exerted on the strip adjacent the nip and producing electrical signals indicative of the sensed forces on the strip. Then, the control system may be capable of receiving the electrical signals indicative of the sensed forces exerted on the strip and causing the actuators 100 to move the casting rolls responsive to the sensed forces exerted on the strip. The control system may be capable of causing an actuator to move at each end of each casting roll responsive to the sensed forces exerted on the strip.

The force sensors may be positioned at each end of each casting roll, and the control system capable of receiving the electrical signals indicative of the sensed forces exerted on the strip from each end of each casting roll separately and causing each actuator to vary the distance between each end of the casting rolls and the given reference location responsive to the electrical signals as desired. The control system is capable of processing the electrical signals from the force sensors 104 indicative of the forces exerted on the strip, and controlling the position of the casting rolls 12 responsive to the signals from the load cells 104, 108 to maintain a desired force urging the casting roll 12 against the thin cast strip. The control system may control the position of each end of each casting roll 12 independently responsive to the electrical signals from the load cells 104, 108.

In addition, profile sensors may be positioned downstream of the nip capable of sensing the strip thickness profile at a plurality of locations along the strip width, and producing electrical signals indicative of the strip thickness profile downstream of the nip. Then, the control system may be capable of processing the electrical signals indicative of the strip thickness profile, and causing the actuators to move the casting rolls and further control the thickness profile of the cast strip responsive to the electrical signals indicative of the strip thickness profile.

Further, temperature profile sensors may be positioned downstream of the nip capable of sensing the strip temperature profile at a plurality of locations along the strip width, and producing electrical signals indicative of the strip temperature profile downstream of the nip. The temperature profile sensors may be positioned to determine the temperatures across the cast strip at segments adjacent the nip or further downstream of the nip, and generate electrical signals corresponding to the strip temperature profile in segments across the strip adjacent the nip. The temperature measurements may be segmented into more than three segments, such as five or more segments, or in a continuum, to provide a strip temperature profile across the cast strip adjacent the nip. Then, the control system may be capable of processing the electrical signals indicative of the strip temperature profile, and causing the actuators to move the casting rolls and further control the thickness profile of the cast strip responsive to the electrical signals indicative of the strip temperature profile. The temperature profile may be measured by a scanning pyrometer or an array temperature sensor.

The control system may control the position of each casting roll 12 separately and by different algorithms. To control the position of the first casting roll, the control system may receive the electrical signals indicative of the casting roll's position in relation to the given reference location and cause the actuator to move the first casting roll into a determined position relative to the given reference location. Then, the control system may continue to receive the electrical signals indicative of that casting roll's position, and when the control system determines that the first casting roll is not in the determined position, cause the actuator to move the first casting roll into the determined position.

To control the position of the second casting roll, the control system may receive the electrical signals indicative of the forces exerted on the strip, and cause one or more actuators to move the second casting roll independent of the first casting roll. The control system may move the second casting roll responsive to the electrical signals indicative of the forces exerted on the strip to vary the distance between the second casting roll and the given reference location to maintain a desired force exerted on the strip. Then, the control system may continue to receive the electrical signals indicative of the forces exerted on the strip, and when the control system determines that the forces exerted on the strip are higher or lower than desired, cause the actuator to move the second casting roll to vary the position of the second casting roll to provide the desired force exerted on the strip.

The control system may determine that the forces exerted on the strip are higher or lower than desired using combined electrical signals from more than one force sensor or load cell 104 by signal summing, signal averaging, signal differencing, or other signal combining. The control system may be capable of receiving and combining the electrical signals indicative of the sensed forces exerted on the strip and causing one or more actuators 100 to vary the position of the casting rolls responsive to the combined electrical signals. Additionally, the control system may be capable of combining the separate electrical signals indicative of the sensed forces exerted on the strip from each end of each casting roll, by combining the electrical signals from force sensors or load cells 104 at each end of one casting roll, then combining the separate electrical signals from force sensors or load cells 104 at each end of the other casting roll. Alternately or in addition, the control system may be capable of combining the electrical signals from force sensors or load cells 104 at an end of one casting roll with the electrical signals from the corresponding end of the other casting roll.

Typically, the electrical signals from the force sensors or load cells from both ends of one casting roll will be combined by signal summing to provide a combined electrical signal indicative of the total force exerted by that casting roll. It is contemplated, however, that various control algorithms may be used, including for example but not limited to:

- The electrical signals from force sensors at both ends of one casting roll may be combined by signal averaging to provide a combined electrical signal indicative of the average force exerted by each end of that casting roll.
- The electrical signals from force sensors at both ends of one casting roll may be combined by signal summing to provide a combined electrical signal indicative of the total force exerted by that casting roll.
- The summed electrical signal indicative of the total force exerted by one casting roll may be combined by signal differencing with the summed electrical signal indicative of the total force exerted by the other casting roll to provide a combined electrical signal indicative of the difference between the forces exerted by the casting rolls.
- The summed electrical signal indicative of the total force exerted by one casting roll may be combined by signal summing with the summed electrical signal indicative of the total force exerted by the other casting roll to provide a combined electrical signal indicative of the total forces exerted by the strip.
- The electrical signals from one end of one casting roll may be combined by signal differencing with the electrical signals from the corresponding end of the other casting roll to provide a combined electrical signal indicative of the difference between the forces exerted by the casting rolls at one end of the casting rolls.
- Electrical signals from two force sensors on the same casting roll or on different casting rolls may be combined by signal differencing to provide a combined electrical signal indicative of the difference between the forces exerted at the two force sensor positions.

By controlling the position of each casting roll independently, the nip 18 between the casting rolls may be positioned relative to the metal delivery nozzle 17 as desired. In the past, when one casting roll was maintained against an adjustable stop, the position of that casting roll relative to the metal delivery nozzle 17 was fixed. In that case, as the strip thickness increased, the pool height was not the same for each casting roll. In the present disclosure, the control system is capable of moving both casting rolls independently. The control system is capable of causing the actuators 100 to move the position of the nip 18 relative to the metal delivery nozzle 17 by moving both casting rolls.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An apparatus for continuously casting metal strip comprising:

(a) a pair of counter-rotatable casting rolls having casting surfaces laterally positioned to form a nip there between through which thin cast strip can be cast, and on which a casting pool of molten metal can be formed supported on the casting surfaces above the nip;

(b) at least one actuator operative for each casting roll capable of moving laterally each casting roll independently toward and away from a given reference location as desired;

(c) location sensors capable of sensing the location of the casting rolls relative to the given reference location and producing electrical signals indicative of each casting roll position in relation to the given reference location; and (d) a control system capable of receiving the electrical signals indicative of each casting roll position and causing the actuator to move the casting rolls into desired position relative to the given reference location for casting the metal strip.

2. The apparatus for continuously casting metal strip as claimed in claim 1 where separate actuators are provided capable of independently moving each end of each casting roll relative to the given reference location as desired.

3. The apparatus for continuously casting metal strip according to claim 1 where the actuators are selected from the group consisting of servo-mechanisms, hydraulic mechanisms, pneumatic mechanisms, rotating actuators, and magnetostrictive actuators and capable of moving the casting rolls independently to vary the distance between each casting roll and the given reference location.

4. The apparatus for continuously casting metal strip according to claim 1 comprising in addition:

force sensors capable of sensing the forces exerted on the strip adjacent the nip and producing electrical signals indicative of forces exerted on the strip; and the control system is capable of receiving the electrical signals indicative of the sensed forces exerted on the strip and causing at least one actuator to independently move the casting rolls responsive to the sensed forces exerted on the strip.

5. The apparatus for continuously casting metal strip as claimed in claim 1 where separate location sensors are provided capable of sensing the position of the casting rolls relative to the given reference location at each end of each casting roll independently.

6. The apparatus for continuously casting metal strip as claimed in claim 5 where separate actuators are provided at each end of each casting roll and capable of independently varying the distance between the casting rolls at each end of each casting roll as desired.

7. The apparatus for continuously casting metal strip according to claim 6 where the actuators are selected for the group consisting of servo-mechanisms, hydraulic mechanisms, pneumatic mechanisms, rotating actuators, and magnetostrictive actuators and capable of moving the casting rolls independently to vary the distance between each casting roll and the given reference location as desired.

8. The apparatus for continuously casting metal strip according to claim 5 comprising in addition:

force sensors at each end of each casting roll capable of sensing the forces exerted on the strip adjacent the nip and producing electrical signals indicative of the sensed forces exerted on the strip; and the control system is capable of receiving the electrical signals indicative of the sensed forces exerted on the strip and causing an actuator to move at each end of each casting roll responsive to the sensed forces exerted on the strip as desired.

9. The apparatus for continuously casting metal strip as claimed in claim 8 where the control system is capable of receiving and combining the separate electrical signals indicative of the sensed forces exerted on the strip from each end of each casting roll and causing the actuators to vary the position of the casting rolls responsive to the combined electrical signals as desired.

10. The apparatus for continuously casting metal strip as claimed in claim 8 where the control system is capable of receiving the electrical signals indicative of the sensed forces exerted on the strip and combining the electrical signals from an end of one casting roll with the electrical signals from the corresponding end of the other casting roll and causing the actuators to vary the position of the casting rolls responsive to the combined electrical signals as desired.

11. The apparatus for continuously casting metal strip as claimed in claim 6 where force sensors at each end of each casting roll capable of sensing the forces exerted on the strip adjacent the nip and producing electrical signals indicative of the sensed forces exerted on the strip; and the control system is capable of receiving the separate electrical signals indicative of the sensed forces exerted on the strip from each end of each casting roll and causing each actuator to vary the distance between each end of the casting rolls and the given reference location responsive to the electrical signals as desired.

12. The apparatus for continuously casting metal strip as claimed in claim 11 where the control system is capable of receiving and combining separate electrical signals indicative of the sensed forces exerted on the strip from each end of each casting roll and causing the actuators to vary the position of each end of each casting roll independently responsive to the combined electrical signals as desired.

13. The apparatus for continuously casting metal strip as claimed in claim 11 where the control system is capable of receiving the electrical signals indicative of the sensed forces exerted on the strip and combining the electrical signals from an end of one casting roll with the electrical signals from the corresponding end of the other casting roll and causing the actuators to vary the position of each end of each casting roll independently responsive to the combined electrical signals as desired.

14. The apparatus for continuously casting strip as claimed in claim 1 further comprising:

profile sensors positioned downstream of the nip capable of sensing the strip thickness profile at a plurality of locations along the strip width and producing electrical signals indicative of the strip thickness profile downstream of the nip; and the control system is capable of processing the electrical signals indicative of the strip thickness profile and causing at least one actuator to move the casting rolls responsive to the electrical signals and further controlling the thickness profile of the cast strip.

15. An apparatus for continuously casting metal strip comprising:

(a) a pair of counter-rotatable casting rolls having casting surfaces laterally positioned to form a nip there between through which thin cast strip can be cast, and on which a casting pool of molten metal can be formed supported on the casting surfaces above the nip;

(b) the pair of casting rolls mounted in a roll cassette;

(c) at least one actuator operative for each casting roll capable of moving laterally each casting roll in the roll cassette independently toward and away from a given reference location as desired;

(d) location sensors capable of sensing the location of the casting rolls relative to the given reference location and producing electrical signals indicative of each casting roll position in relation to the given reference location; and (e) a control system capable of receiving the electrical signals indicative of the casting roll position and causing the actuator to move the casting rolls on the roll cassette into desired position relative to the given reference location for casting the metal strip.

16. The apparatus for continuously casting metal strip as claimed in claim 15 where separate actuators are provided capable of independently moving each end of each casting roll relative to the given reference location as desired.

17. The apparatus for continuously casting metal strip as claimed in claim 15 where the actuators are selected from the group consisting of servo-mechanisms, hydraulic mechanisms, pneumatic mechanisms, rotating actuators, and magnetostrictive actuators and capable of moving the casting rolls to independently vary the distance between each casting roll and the given reference location.

18. The apparatus for continuously casting metal strip as claimed in claim 15 comprising in addition:

force sensors at each end of each casting roll capable of sensing the forces exerted on the strip adjacent the nip and producing electrical signals indicative of force exerted on the strip; and the control system capable of receiving the electrical signals indicative of the forces exerted on the strip and causing one or more actuators to move the casting rolls responsive to the sensed forces exerted on the strip as desired.

19. The apparatus for continuously casting metal strip as claimed in claim 15 where separate location sensors are provided capable of sensing the position of the casting rolls relative to the given reference location at each end of each casting roll independently.

20. The apparatus for continuously casting metal strip as claimed in claim 19 where separate actuators are provided at each end of each casting roll and capable of varying the distance between the casting rolls at each end of each casting roll independently as desired.

21. The apparatus for continuously casting metal strip as claimed in claim 18 where the control system is capable of receiving and combining the separate electrical signals indicative of the sensed forces exerted on the strip from each end of each casting roll and causing one or more actuators to vary the position of the casting rolls responsive to the combined electrical signals.

22. The apparatus for continuously casting metal strip as claimed in claim 15 further comprising:

force sensors at each end of each casting roll capable of sensing the forces exerted on the strip adjacent the nip and producing electrical signals indicative of the sensed forces exerted on the strip; and the control system is capable of receiving the separate electrical signals indicative of the sensed forces exerted on the strip from each end of each casting roll and causing each actuator to vary the distance between each end of the casting rolls and the given reference location responsive to the electrical signals as desired.

23. The apparatus for continuously casting metal strip as claimed in claim 22 where the control system is capable of receiving and combining separate electrical signals indicative of the sensed forces exerted on the strip from each end of each roll and causing one or more actuators to vary the position of each end of each casting roll independently responsive to the combined electrical signals.

24. The apparatus for continuously casting metal strip as claimed in claim 16 where the control system is capable of receiving and combining separate electrical signals indicative of the positions relative to the given reference location from each end of each roll and causing one or more actuators to vary the position of each end of each casting roll independently responsive to the combined electrical signals.

25. The apparatus for continuously casting metal strip according to claim 15 where the actuator is disconnectable from the roll cassette to enable the casting rolls to be changed out without dismantling the actuator.

26. The apparatus for continuously casting strip as claimed in claim 25 further comprising:

profile sensors positioned downstream of the nip capable of sensing the strip thickness profile at a plurality of locations along the strip width and producing electrical signals indicative of the strip thickness profile downstream of the nip; and the control system is capable of processing the electrical signals indicative of the strip thickness profile and causing at least one actuator to move the casting rolls responsive to the electrical signals and further controlling the thickness profile of the cast strip.

27. A method of continuously casting metal strip comprising:

(a) assembling a pair of counter-rotatable casting rolls having casting surfaces laterally positioned to form a nip there between through which thin cast strip can be cast, and on which a casting pool of molten metal can be formed supported on the casting surfaces above the nip;

(b) sensing the location of the casting rolls relative to a given reference location and producing electrical signals indicative of each casting roll position in relation to the given reference location;

(c) controlling the location of each casting roll responsive to the electrical signals indicative of the position of the casting rolls; and (d) moving each casting roll independently by least one actuator operable for each roll toward and away from the given reference location as desired.

28. The method of continuously casting metal strip as claimed in claim 27 comprising the further step of:

independently moving each end of each casting roll relative to the given reference location.

29. The method of continuously casting metal strip as claimed in claim 27 where the moving step is performed with actuators selected from the group consisting of servo-mechanisms, hydraulic mechanisms, pneumatic mechanisms, rotating actuators, and magnetostrictive actuators and capable of moving the casting rolls independently to vary the distance between each casting roll and the given reference location.

30. The method of continuously casting metal strip as claimed in claim 27 comprising the further steps of:

sensing the forces exerted on the strip adjacent the nip and producing electrical signals indicative of force exerted on the strip; and causing one or more actuators to move the casting rolls responsive to the electrical signals indicative of the forces exerted on the strip to vary the distance between the casting rolls and the given reference location as desired.

31. The method of continuously casting metal strip as claimed in claim 30 where controlling the location of each casting roll includes receiving and combining the separate electrical signals indicative of the sensed forces exerted on the strip from each end of each casting roll and causing one or more actuators to vary the position of the casting rolls responsive to the combined electrical signals.

32. The method of continuously casting metal strip as claimed in claim 27 where:

the sensing step is performed by location sensors positioned at each end of each casting roll; and the moving step is performed by actuators moving each end of each casting roll relative to the given reference location as desired.

33. The method of continuously casting metal strip as claimed in claim 32 where the moving step is performed by varying the distance between the casting rolls at each end of each casting roll independently as desired.

34. The method of continuously casting metal strip as claimed in claim 32 comprising the further steps of:

sensing the forces exerted on the strip adjacent the nip at each end of each casting roll and producing electrical signals indicative of force exerted on the strip; and causing the actuators to move each end of each casting roll responsive to the electrical signals indicative of the forces exerted on the strip to vary the distance between each end of the casting roll and the given reference location as desired.

35. The method of continuously casting metal strip as claimed in claim 34 where controlling the location of each casting roll includes receiving and combining the separate electrical signals indicative of the sensed forces exerted on the strip from each end of each casting roll and causing one or more actuators to vary the position of each end of the casting rolls responsive to the combined electrical signals.

36. The method of continuously casting metal strip as claimed in claim 27 where controlling the location of each casting roll includes receiving and combining the electrical signals indicative of the position of each end of the each casting roll relative to the given reference location and causing one or more actuators to vary the position of each end of the casting rolls responsive to the combined electrical signals.

37. The method of continuously casting metal strip as claimed in claim 27 where the moving step is performed by controlling forces adjacent the nip urging each roll against the thin cast strip there between during casting.

38. The method of continuously casting strip as claimed in claim 27 further comprising the steps of:

sensing the strip thickness profile downstream of the nip at a plurality of locations along the strip width and producing electrical signals indicative of the strip thickness profile downstream of the nip; and moving the casting rolls and further controlling the thickness profile of the cast strip responsive to the electrical signals.

39. A method of continuously casting metal strip comprising:

(a) assembling a pair of counter-rotatable casting rolls having casting surfaces laterally positioned to form a nip there between through which thin cast strip can be cast, and on which a casting pool of molten metal can be formed supported on the casting surfaces above the nip, each casting roll mounted on a roll cassette, each casting roll being mounted to be capable of moving toward and away from the nip during casting;

(b) moving the casting rolls independently by at least one actuator operable for each roll toward and away from a given reference location as desired;

(c) sensing the location of the casting rolls relative to the given reference location and producing electrical signals indicative of each casting roll position in relation to the given reference location; and (d) controlling the actuators responsive to the electrical signals indicative of the position of the casting rolls and moving the casting rolls on the roll cassette into desired position for casting metal strip.

40. The method of continuously casting metal strip as claimed in claim 39 where the moving step is performed by one or more actuators selected from the group consisting of servo-mechanisms, hydraulic mechanisms, pneumatic mechanisms, rotating actuators, and magnetostrictive actuators and capable of moving the casting rolls independently to vary the distance between each casting roll and the given reference location.

41. The method of continuously casting metal strip as claimed in claim 39 where the moving step is performed by varying the distance between the casting rolls at each end of each casting roll independently.

42. The method of continuously casting metal strip as claimed in claim 39 where the moving step is performed by controlling forces adjacent the nip urging each roll against the thin cast strip there between during casting.

43. The method of continuously casting metal strip as claimed in claim 39 comprising the additional step of:

disconnecting the roll cassette to enable the casting rolls to be changed out without dismantling the actuators.

44. The method of continuously casting strip as claimed in claim 39 further comprising sensing the strip thickness profile downstream of the nip at a plurality of locations along the strip width and producing electrical signals indicative of the strip thickness profile downstream of the nip; and causing the actuators to move the casting rolls and further controlling the thickness profile of the cast strip responsive to the electrical signals as desired.

* * * * *